US008881558B2

(12) United States Patent
Misner et al.

(10) Patent No.: US 8,881,558 B2
(45) **Date of Patent: *Nov. 11, 2014**

(54) COMBINATION AND KEY OPERATED LOCKS WITH INDICATORS

(75) Inventors: Michael O. Misner, Lake Villa, IL (US); Jian-Bing Lu, Shanghai (CN); Xiuxing Lai, Dong Guan (CN)

(73) Assignee: The Eastern Company, Wheeling, IL (US)

( * ) Notice: Subject to any disclaimer, the term of this patent is extended or adjusted under 35 U.S.C. 154(b) by 46 days.

This patent is subject to a terminal disclaimer.

(21) Appl. No.: 13/507,156

(22) Filed: Jun. 8, 2012

(65) Prior Publication Data

US 2012/0304711 A1 Dec. 6, 2012

Related U.S. Application Data

(60) Continuation-in-part of application No. 12/807,968, filed on Sep. 17, 2010, now Pat. No. 8,201,423, which is a division of application No. 11/978,238, filed on Oct. 27, 2007, now Pat. No. 7,832,238, which is a continuation-in-part of application No. 11/519,753, filed on Sep. 12, 2006, now Pat. No. 7,363,782, which is a continuation of application No. 11/317,545, filed on Dec. 23, 2005, now Pat. No. 7,159,422, which is a continuation of application No. 11/098,205, filed on Apr. 4, 2005, now Pat. No. 7,007,521, which is a continuation of application No. 10/634,201, filed on Aug. 5, 2003, now Pat. No. 6,877,345.

(51) Int. Cl.

| | |
|---|---|
| ***E05B 37/06*** | (2006.01) |
| ***E05B 39/00*** | (2006.01) |
| ***E05B 37/00*** | (2006.01) |
| ***E05B 37/02*** | (2006.01) |
| ***E05B 35/10*** | (2006.01) |

(52) U.S. Cl.

CPC ..... *E05B 37/0034* (2013.01); *E05B 39/00* (2013.01); *E05B 37/025* (2013.01); *E05B 35/105* (2013.01)

USPC ..... 70/21; 70/25; 70/38 A; 70/284; 70/285; 70/432

(58) Field of Classification Search

USPC ..... 70/21, 25–30, 38 A, 284, 285, 432

See application file for complete search history.

(56) References Cited

U.S. PATENT DOCUMENTS

| | | | | |
|---|---|---|---|---|
| 59,615 | A | 11/1866 | Lawshe | 70/437 |
| 62,862 | A | 3/1867 | Leyden | 70/437 |
| 70,409 | A | 11/1867 | Chambers | 70/437 |
| 80,637 | A | 8/1868 | Lalor | 70/437 |
| 85,630 | A | 1/1869 | Altmaeir | 70/437 |

(Continued)

OTHER PUBLICATIONS

Prestolock By CCL Security Products, New Britain, CT 06051 2-Page Brochure HPL994-01—1994-.

(Continued)

*Primary Examiner* — Suzanne Barrett
(74) *Attorney, Agent, or Firm* — David A. Burge

(57) ABSTRACT

A lock for luggage, travelcases, briefcases and the like that can be unlocked by setting a combination using a combination mechanism of the lock, and, alternatively, by using a key in a key mechanism of the lock. An indicator of the lock moves to signal when the lock has been unlocked by use of the key mechanism. In some embodiments the indicator can only be reset after the lock has been unlocked using the combination mechanism. In some embodiments the indicator is automatically reset when the lock is unlocked using the combination mechanism. In some embodiments the lock is a padlock that has a shackle defined, at least in part, by a flexible cable.

29 Claims, 19 Drawing Sheets

(56) References Cited

U.S. PATENT DOCUMENTS

| | | | | |
|---|---|---|---|---|
| 98,513 | A | 1/1870 | Mix et al. | 70/437 |
| 107,414 | A | 9/1870 | Shepardson | 70/437 |
| 123,558 | A | 2/1872 | Dopp | 70/437 |
| 137,181 | A | 3/1873 | Cooper | 70/437 |
| 162,663 | A | 4/1875 | Kinsman | 70/437 |
| 170,889 | A | 12/1875 | Norman | 70/437 |
| 198,837 | A | 1/1878 | Caton | 70/437 |
| RE8,212 | E | 5/1878 | Lalor | 70/437 |
| 210,540 | A | 12/1878 | Kinsman | 70/437 |
| 218,252 | A | 8/1879 | Gartley | 70/437 |
| 219,495 | A | 9/1879 | Mix | 70/437 |
| 220,124 | A | 9/1879 | Clarke | 70/437 |
| 223,955 | A | 1/1880 | Russell | 70/436 |
| 232,069 | A | 9/1880 | Russell | 70/437 |
| 232,070 | A | 9/1880 | Russell | 70/437 |
| RE9,462 | E | 11/1880 | Mix | 70/437 |
| 236,349 | A | 1/1881 | Mix | 70/437 |
| RE9,567 | E | 2/1881 | Cooper | 70/437 |
| 241,691 | A | 5/1881 | Mix | 70/437 |
| RE9,747 | E | 6/1881 | Leyden | 70/437 |
| 252,120 | A | 1/1882 | McNeven | 70/437 |
| 265,584 | A | 10/1882 | Dickerman et al. | 70/437 |
| 274,875 | A | 3/1883 | Yoe | 70/437 |
| 287,028 | A | 10/1883 | Jackson | 70/437 |
| RE10,440 | E | 1/1884 | Jackson | 70/437 |
| 307,254 | A | 10/1884 | Ashford | 70/437 |
| 340,427 | A | 4/1886 | De La Hooke | 70/437 |
| 344,176 | A | 6/1886 | Edgar | 70/437 |
| 347,618 | A | 8/1886 | Knowles | 70/28 |
| 352,085 | A | 11/1886 | Edgar | 70/437 |
| 353,139 | A | 11/1886 | Jones | 70/437 |
| 361,294 | A | 4/1887 | Jillson | 70/437 |
| 426,097 | A | 4/1890 | Barr | 70/437 |
| 427,284 | A | 5/1890 | Ward | 70/437 |
| 428,711 | A | 5/1890 | Barr | 70/437 |
| 449,314 | A | 3/1891 | Edgar | 70/437 |
| 452,433 | A | 5/1891 | Beasley | 70/437 |
| 458,125 | A | 8/1891 | Edgar | 70/437 |
| 497,640 | A | 5/1893 | Doremus et al. | 70/437 |
| 499,500 | A | 6/1893 | Beasley | 70/437 |
| 536,195 | A | 3/1895 | Edgar | 70/437 |
| 536,196 | A | 3/1895 | Edgar | 70/437 |
| 536,397 | A | 3/1895 | Roraback | 70/437 |
| 548,523 | A | 10/1895 | Curtis | 70/437 |
| 551,154 | A | 12/1895 | Beasley | 70/437 |
| 562,059 | A | 6/1896 | Wolcott | 70/437 |
| 399,189 | A | 3/1899 | Edgar | 70/437 |
| 400,316 | A | 3/1899 | Doremus | 70/437 |
| 415,358 | A | 11/1899 | Egge | 70/437 |
| 688,495 | A | 12/1901 | Van Horn | 70/437 |
| 714,054 | A | 11/1902 | Stebbins | 70/437 |
| 718,359 | A | 1/1903 | Koerber | 70/432 |
| 723,350 | A | 3/1903 | Yoe | 70/437 |
| 736,189 | A | 8/1903 | Yoe | 70/437 |
| 771,092 | A | 9/1904 | Ramey | 70/435 |
| 844,702 | A | 2/1907 | Wells | 70/437 |
| 856,843 | A | 6/1907 | Carlisle | 70/438 |
| 883,991 | A | 4/1908 | Wells | 70/437 |
| 934,959 | A | 9/1909 | Crow | 70/437 |
| 936,231 | A | 10/1909 | Arens et al. | 70/438 |
| 941,028 | A | 11/1909 | Murphy | 70/285 |
| 972,171 | A | 10/1910 | Dupont | 70/21 |
| 999,044 | A | 7/1911 | Kuster | 70/145 |
| 1,002,356 | A | 9/1911 | Auerbach | 70/437 |
| 1,153,614 | A | 9/1915 | Forsheim et al. | 70/437 |
| 1,161,158 | A | 11/1915 | Rennert | 70/432 |
| 1,165,545 | A | 12/1915 | Shipman | 70/437 |
| 1,168,340 | A | 1/1916 | Shipman | 70/437 |
| 1,194,241 | A | 8/1916 | Savage | 70/437 |
| 1,200,949 | A | 10/1916 | Johnson | 70/437 |
| 1,248,561 | A | 12/1917 | Shipman | 70/437 |
| 1,267,894 | A | 5/1918 | Olson | 70/30 |
| 1,308,458 | A | 1/1919 | Voight | 70/437 |
| 1,486,037 | A | 3/1924 | Rosseau | 70/437 |
| 1,755,521 | A | 4/1930 | Smith | 70/21 |
| 1,757,020 | A | 5/1930 | Ramey | 70/437 |
| 1,937,523 | A | 12/1933 | Machinest | 70/53 |
| 1,981,163 | A | 11/1934 | Carlson | 70/53 |
| 2,049,416 | A | 8/1936 | Aldeen | 70/113 |
| 2,110,094 | A | 3/1938 | Pauloski et al. | 70/284 |
| 2,163,852 | A | 6/1939 | Pond | 70/21 |
| 2,315,102 | A | 3/1943 | Adams | 70/432 |
| 2,487,608 | A | 11/1949 | Soref et al. | 70/21 |
| 2,546,182 | A | 3/1951 | Fenari | 70/312 |
| 2,725,739 | A | 12/1955 | Check | 70/285 |
| 2,793,522 | A | 5/1957 | Tornoe | 70/432 |
| 2,834,195 | A | 5/1958 | Stackhouse | 70/339 |
| 2,839,322 | A | 6/1958 | Kirk | 292/251 |
| 2,923,928 | A | 2/1960 | McLaughlin | 340/274 |
| 2,926,514 | A | 3/1960 | Junkune | 70/21 |
| 2,931,203 | A | 4/1960 | Check | 70/21 |
| 2,931,204 | A | 4/1960 | Check | 70/21 |
| 2,995,025 | A | 8/1961 | Toepfer | 70/58 |
| 3,009,345 | A | 11/1961 | Check | 70/21 |
| 3,050,977 | A | 8/1962 | Foote et al. | 70/332 |
| 3,221,526 | A | 12/1965 | Stackhouse | 70/437 |
| 3,349,584 | A | 10/1967 | Russell et al. | 70/21 |
| 3,472,049 | A | 10/1969 | Sewell | 70/21 |
| 3,503,642 | A | 3/1970 | Poe | 292/101 |
| 3,720,082 | A | 3/1973 | Feinberg et al. | 70/25 |
| 3,750,431 | A | 8/1973 | Atkinson | 70/21 |
| 3,789,639 | A | 2/1974 | Canter | 70/437 |
| 3,800,571 | A | 4/1974 | Heine | 70/71 |
| 3,823,584 | A | 7/1974 | Gill | 70/21 |
| 3,824,819 | A | 7/1974 | Neary | 70/432 |
| 3,855,829 | A | 12/1974 | Falk | 70/38 |
| 3,894,415 | A | 7/1975 | Bako | 70/21 |
| 3,952,561 | A | 4/1976 | Bako | 70/70 |
| 4,014,191 | A | 3/1977 | Harrington et al. | 70/25 |
| 4,055,972 | A | 11/1977 | Calegan | 70/21 |
| 4,170,884 | A | 10/1979 | Calegan | 70/21 |
| 4,308,731 | A | 1/1982 | Remington | 70/74 |
| 4,341,101 | A | 7/1982 | Bako | 70/284 |
| 4,343,164 | A | 8/1982 | Bako | 70/312 |
| 4,343,165 | A | 8/1982 | Bako | 70/312 |
| 4,354,366 | A | 10/1982 | Bako | 70/312 |
| 4,355,524 | A | 10/1982 | Bako | 70/312 |
| 4,444,029 | A | 4/1984 | Remington | 70/25 |
| 4,450,698 | A | 5/1984 | Scelba | 70/312 |
| 4,453,390 | A | 6/1984 | Moritz et al. | 70/434 |
| 4,462,231 | A | 7/1984 | Zabel | 70/21 |
| 4,490,999 | A | 1/1985 | Castle et al. | 70/432 |
| 4,514,915 | A | 5/1985 | Galetta | 36/1 |
| 4,559,796 | A | 12/1985 | DeForrest, Sr. | 70/432 |
| 4,583,775 | A | 4/1986 | Bisbing | 292/64 |
| 4,651,544 | A | 3/1987 | Hungerford | 70/63 |
| 4,730,467 | A | 3/1988 | Lebrecht | 70/25 |
| 4,733,548 | A | 3/1988 | Ling | 70/25 |
| 4,770,013 | A | 9/1988 | Nakai | 70/285 |
| 4,829,794 | A | 5/1989 | Crown | 70/25 |
| 4,829,795 | A | 5/1989 | Taylor | 70/54 |
| 4,885,923 | A | 12/1989 | Nakai | 70/284 |
| 4,914,732 | A | 4/1990 | Henderson et al. | 340/825.17 |
| D321,824 | S | 11/1991 | Appelbaum | D8/334 |
| 5,082,169 | A | 1/1992 | Aurness et al. | 232/17 |
| 5,125,248 | A | 6/1992 | Ling | 70/25 |
| D331,908 | S | 12/1992 | Hollander et al. | D13/133 |
| 5,327,752 | A | 7/1994 | Myers et al. | 70/58 |
| 5,381,685 | A | 1/1995 | Carl et al. | 70/78 |
| 5,408,212 | A | 4/1995 | Meyers et al. | 340/427 |
| 5,460,020 | A | 10/1995 | Hungerford | 70/63 |
| 5,493,878 | A | 2/1996 | Murray, Jr. et al. | 70/58 |
| 5,502,989 | A | 4/1996 | Murray, Jr. et al. | 70/58 |
| 5,520,032 | A | 5/1996 | Ling | 70/25 |
| D372,187 | S | 7/1996 | Ling | D8/334 |
| 5,588,877 | A | 12/1996 | Davis et al. | 439/660 |
| 5,595,080 | A | 1/1997 | Whinton | 70/432 |
| 5,715,709 | A | 2/1998 | Lai | 70/25 |
| 5,791,172 | A | 8/1998 | Deighton et al. | 70/63 |
| 5,794,466 | A | 8/1998 | Hungerford et al. | 70/63 |
| D400,170 | S | 10/1998 | Asai et al. | D13/133 |
| D406,522 | S | 3/1999 | Ling | D8/334 |
| 5,881,582 | A | 3/1999 | Monaco | 70/14 |
| 5,911,764 | A | 6/1999 | Wei-Kong | 70/160 |

(56) References Cited

U.S. PATENT DOCUMENTS

| | | | | |
|---|---|---|---|---|
| 5,916,283 | A | 6/1999 | Steinbach | 70/456 |
| 6,035,672 | A | 3/2000 | Lai | 70/25 |
| 6,047,572 | A | 4/2000 | Bliven et al. | 70/58 |
| 6,047,575 | A | 4/2000 | Larson et al. | 70/278 |
| 6,047,577 | A | 4/2000 | Klimas | 70/340 |
| D424,016 | S | 5/2000 | Gipson et al. | D13/133 |
| 6,070,442 | A | 6/2000 | Neeley et al. | 70/175 |
| 6,100,802 | A | 8/2000 | Adams | 340/542 |
| 6,146,181 | A | 11/2000 | Plaza | 439/357 |
| D434,966 | S | 12/2000 | Ling | D8/334 |
| 6,164,096 | A | 12/2000 | Lai | 70/25 |
| D444,768 | S | 7/2001 | Kishi | D13/133 |
| D450,232 | S | 11/2001 | Taylor et al. | D8/335 |
| D451,002 | S | 11/2001 | Lai | D8/334 |
| 6,315,485 | B1 | 11/2001 | Speck et al. | 403/7 |
| 6,408,660 | B1 | 6/2002 | Lai | 70/30 |
| 6,474,116 | B1 | 11/2002 | Lai | 70/25 |
| 6,513,356 | B1 | 2/2003 | Yang | 70/213 |
| 6,516,643 | B1 | 2/2003 | Olshausen | 70/337 |
| D471,872 | S | 3/2003 | Kawase | D13/147 |
| D472,877 | S | 4/2003 | Jaag | D13/133 |
| 6,539,761 | B2 | 4/2003 | Yang | 70/284 |
| 6,553,795 | B1 | 4/2003 | Trempala | 70/167 |
| D474,674 | S | 5/2003 | Ling | D8/343 |
| 6,575,005 | B1 | 6/2003 | Hunter | 70/432 |
| 6,615,626 | B2 | 9/2003 | Yu et al. | 70/301 |
| D486,720 | S | 2/2004 | Ling | D8/334 |
| 6,708,532 | B2 | 3/2004 | Winland | 70/2 |
| 6,708,534 | B1 | 3/2004 | Ruan | 70/38 |
| 6,732,664 | B2 | 5/2004 | Worrall | 109/68 |
| 6,742,366 | B1 | 6/2004 | Lai | 70/58 |
| D497,303 | S | 10/2004 | Sun | D8/334 |
| 6,799,445 | B1 | 10/2004 | Tsai | 70/30 |
| 6,848,283 | B1 | 2/2005 | Lin | 70/21 |
| 6,860,125 | B1 | 3/2005 | Yu | 70/25 |
| 6,877,345 | B1 | 4/2005 | Misner et al. | 70/21 |
| 6,880,370 | B2 | 4/2005 | Yu | 70/25 |
| 6,883,354 | B1 | 4/2005 | Yu | 70/18 |
| 6,904,776 | B1 | 6/2005 | Lin | 70/25 |
| 6,912,879 | B1 | 7/2005 | Yu | 70/58 |
| 6,938,445 | B2 | 9/2005 | Huang | 70/107 |
| 7,007,521 | B1 | 3/2006 | Misner et al. | 70/21 |
| 7,021,092 | B2 | 4/2006 | Loughlin et al. | 70/56 |
| 7,021,537 | B2 | 4/2006 | Tropp | 235/384 |
| 7,036,728 | B2 | 5/2006 | Tropp | 235/384 |
| 7,100,401 | B2 | 9/2006 | Yu | 70/21 |
| 7,117,698 | B2 | 10/2006 | Lai | 70/21 |
| 7,121,123 | B2 | 10/2006 | Yu | 70/21 |
| 7,131,299 | B1 | 11/2006 | Huang | 70/21 |
| 7,140,209 | B2 | 11/2006 | Lai | 70/25 |
| D535,177 | S | 1/2007 | Hsieh | D8/333 |
| D535,548 | S | 1/2007 | Lin | D8/334 |
| 7,155,943 | B1 | 1/2007 | Lin | 70/21 |
| 7,155,944 | B1 | 1/2007 | Lin | 70/21 |
| 7,159,422 | B1 | 1/2007 | Misner et al. | 70/21 |
| 7,201,026 | B2 | 4/2007 | Yu | 70/21 |
| 7,204,108 | B2 | 4/2007 | Yu | 70/21 |
| 7,216,517 | B2 | 5/2007 | Ling et al. | 70/21 |
| 7,225,648 | B2 | 6/2007 | Lai et al. | 70/21 |
| D550,062 | S | 9/2007 | Smaldone | D8/339 |
| 7,269,985 | B2 | 9/2007 | Lai et al. | 70/446 |
| 7,290,417 | B1 | 11/2007 | Huang | 70/285 |
| 7,331,204 | B1 | 2/2008 | Hsieh | 70/69 |
| 7,340,927 | B2 | 3/2008 | Yu et al. | 70/21 |
| 7,357,007 | B2 | 4/2008 | Lin | 70/21 |
| 7,357,008 | B2 | 4/2008 | Yu | 70/58 |
| 7,363,782 | B1 | 4/2008 | Misner et al. | 70/21 |
| 7,370,497 | B2 | 5/2008 | Yu | 70/21 |
| 7,370,498 | B1 | 5/2008 | Miao | 70/21 |
| 7,370,499 | B1 | 5/2008 | Lee | 70/58 |
| 7,380,427 | B2 | 6/2008 | Elles et al. | 70/285 |
| 7,415,853 | B2 | 8/2008 | Yu | 70/68 |
| 7,424,813 | B2 | 9/2008 | Wu | 70/58 |
| 7,467,531 | B2 | 12/2008 | Lai et al. | 70/38 |
| 7,493,785 | B2 | 2/2009 | Yu et al. | 70/21 |
| 7,497,102 | B2 | 3/2009 | Yu | 70/58 |
| 7,520,150 | B2 | 4/2009 | Yu | 70/31 |
| 7,523,628 | B2 | 4/2009 | Yu | 70/21 |
| 7,552,607 | B2 | 6/2009 | Yang | 70/21 |
| 7,562,545 | B2 | 7/2009 | Lai et al. | 70/21 |
| 7,568,367 | B2 | 8/2009 | Huang | 70/58 |
| 7,571,627 | B2 | 8/2009 | Yu | 70/21 |
| 7,628,045 | B2 | 12/2009 | Yu | 70/21 |
| 7,631,524 | B2 | 12/2009 | Araujo | 70/25 |
| 7,661,278 | B1 | 2/2010 | Yang | 70/38 |
| 7,698,913 | B2 | 4/2010 | Lee | 70/21 |
| 7,765,840 | B2 | 8/2010 | Lai et al. | 70/21 |
| 7,770,421 | B2 | 8/2010 | Yu | 70/21 |
| 7,779,657 | B2 | 8/2010 | Yu | 70/21 |
| 7,832,238 | B2 | 11/2010 | Misner et al. | 70/21 |
| D639,635 | S | 6/2011 | Kemppainen et al. | D8/334 |
| 8,011,212 | B2 | 9/2011 | Yu | 70/21 |
| 8,037,725 | B2 | 10/2011 | Levine | 70/432 |
| 8,056,376 | B2 | 11/2011 | Yu | 70/21 |
| 8,145,576 | B2 | 3/2012 | Tropp | 705/325 |
| 8,171,760 | B2 | 5/2012 | Yen et al. | 70/25 |
| 8,186,187 | B2 | 5/2012 | Loughlin et al. | 70/21 |
| 8,201,423 | B1 | 6/2012 | Misner | 70/21 |
| 8,353,184 | B2 | 1/2013 | Ling et al. | 70/21 |
| 8,505,343 | B2 | 8/2013 | Yu et al. | 70/21 |
| 8,511,118 | B2 | 8/2013 | Lai et al. | 70/21 |
| 8,539,799 | B2 | 9/2013 | Nave et al. | 70/21 |
| D691,457 | S | 10/2013 | Wang | D8/334 |
| 8,544,301 | B2 | 10/2013 | Nave | 70/21 |
| 8,555,683 | B1 | 10/2013 | Rieder | 70/68 |
| 8,578,743 | B2 | 11/2013 | Yu | 70/30 |
| 8,621,899 | B2 | 1/2014 | Kuo et al. | 70/21 |
| 8,720,236 | B2 | 5/2014 | Ling et al. | 70/21 |
| 2002/0088256 | A1 | 7/2002 | Taylor et al. | 70/38 |
| 2003/0089147 | A1 | 5/2003 | Yang | 70/284 |
| 2004/0226323 | A1 | 11/2004 | Ling et al. | 70/25 |
| 2004/0226324 | A1 | 11/2004 | Loughlin et al. | 70/25 |
| 2004/0255624 | A1 | 12/2004 | Loughlin et al. | 70/56 |
| 2005/0034492 | A1 | 2/2005 | Yu | 70/25 |
| 2005/0039500 | A1 | 2/2005 | Yu | 70/25 |
| 2005/0044902 | A1 | 3/2005 | Yu | 70/25 |
| 2005/0072196 | A1 | 4/2005 | Ling et al. | 70/284 |
| 2005/0092036 | A1 | 5/2005 | Lai | 70/23 |
| 2005/0098629 | A1 | 5/2005 | Tropp | 235/384 |
| 2005/0154605 | A1 | 7/2005 | Tropp | 705/1 |
| 2005/0155397 | A1 | 7/2005 | Yu | 70/58 |
| 2005/0167494 | A1 | 8/2005 | Tropp | 235/384 |
| 2005/0223758 | A1 | 10/2005 | Yu | 70/63 |
| 2005/0229655 | A1 | 10/2005 | Yu | 70/63 |
| 2005/0235705 | A1 | 10/2005 | Ling et al. | 70/25 |
| 2005/0235706 | A1 | 10/2005 | Ling et al. | 70/29 |
| 2005/0262902 | A1 | 12/2005 | Ling et al. | 70/21 |
| 2005/0262903 | A1 | 12/2005 | Ling et al. | 70/21 |
| 2006/0032274 | A1 | 2/2006 | Yu | 70/25 |
| 2006/0107708 | A1 | 5/2006 | Yu | 70/21 |
| 2006/0107709 | A1 | 5/2006 | Yu | 70/21 |
| 2006/0107710 | A1 | 5/2006 | Yu | 70/25 |
| 2006/0150690 | A1 | 7/2006 | Lai et al. | 70/21 |
| 2006/0218980 | A1 | 10/2006 | Yu | 70/21 |
| 2006/0260369 | A1 | 11/2006 | Lai et al. | 70/38 |
| 2006/0266084 | A1 | 11/2006 | Kuo et al. | 70/21 |
| 2007/0175247 | A1 | 8/2007 | Yu | 70/58 |
| 2007/0227202 | A1 | 10/2007 | Yen et al. | 70/21 |
| 2008/0110216 | A1 | 5/2008 | Dalton et al. | 70/21 |
| 2008/0307839 | A1 | 12/2008 | Yu | 70/330 |
| 2010/0064738 | A1 | 3/2010 | Yi | 70/24 |
| 2010/0257907 | A1 | 10/2010 | Yu et al. | 70/284 |
| 2012/0011903 | A1 | 1/2012 | Yu | 70/52 |
| 2012/0073337 | A1 | 3/2012 | Yu | 70/21 |
| 2012/0279264 | A1 | 11/2012 | Yu | 70/21 |
| 2013/0227995 | A1 | 9/2013 | Tropp | 70/20 |

OTHER PUBLICATIONS

Lock-In Royalty, Prestolock Keyless Security, New Britain CT 06051 2-Page Brochure Depicting #2430 & #2400 Padlocks—1994-.

3 Pages of Information About Samsonite "Travel Sentry" Products/Straps E&B Giftware LLC, Yonkers, NY 10701—2005-.

Japan Application Showa 5 No. 11247 Apr. 19, 1931 Entitled "Padlock" Accompanied By English Translation.

COMBINATION AND KEY OPERATED LOCKS WITH INDICATORS

REFERENCE TO RELATED APPLICATIONS

This application is a continuation-in-part of application Ser. No. 12/807,968 filed Sep. 17, 2000, which was a division of application Ser. No. 11/978,238 filed Oct. 27, 2007 and issued Nov. 16, 2010 as U.S. Pat. No. 7,832,238, which was a continuation-in-part of application Ser. No. 11/519,753 filed Sep. 12, 2006 and issued Apr. 28, 2008 as U.S. Pat. No. 7,363,782, which was a continuation of application Ser. No. 11/317,545 filed Dec. 23, 2005 and issued Jan. 9, 2007 as U.S. Pat. No. 7,159,422, which was, in turn, a continuation of application Ser. No. 11/098,205 filed Apr. 4, 2005 and issued Mar. 7, 2006 as U.S. Pat. No. 7,007,521, which was a continuation of application Ser. No. 10/634,201 filed Aug. 5, 2003 and issued Apr. 12, 2005 as U.S. Pat. No. 6,877,345. The applications identified above are referred to later herein as the "Key/Combo/Indicator Cases."

The attention of the Office also is directed to a concurrently filed design application of Michael Misner et al, Ser. No. 29/421,182, entitled CABLE SHACKLE PADLOCK HAVING A SIDEWALL APERTURE FOR A STATUS INDICATOR.

The disclosures of the several applications that are identified above, and the disclosures of any patents that may have issued therefrom as of the filing date of the present application, are incorporated herein by reference, in their entirety.

BACKGROUND OF THE INVENTION

The Key/Combo/Indicator Cases referenced above disclose combination operated locks of the type typically used to secure luggage, travelcases, briefcases and the like during travel and transport. The combination operated locks disclosed in the Key/Combo/Indicator Cases include padlocks that also may be operated by a key or key-like tool such as may be possessed by the federal government to facilitate inspection of the contents of luggage, travelcases, briefcases and the like on which the padlocks are installed and/or that are secured by the padlocks. Padlocks disclosed in the referenced Key/Combo/Indicator Cases also are provided with status indicators capable of visually signalling that a key or key-like tool has been used to unlock the associated lock, typically to enable governmental inspection of the contents of an associated piece of luggage, travelcase, briefcase or the like.

Combination operated locks including padlocks and locks of other kinds that are installed on hardcases such briefcases and the like are widely used by travelers who appreciate the convenience of dialing a simple combination to open their luggage without having to carry, locate and make use of a proper key each time a travel bag is to be opened and relocked.

When the Transportation Security Administration took over the handling of airport security in accordance with the Homeland Security Act, an intensified effort made to inspect the locked travel bags of airline passengers often resulted in the destruction of the combination locks used to secure luggage, travelcases, briefcases and the like when these locks were forcibly opened to permit inspection of contents. The forcible opening and/or removal of combination operated locks for inspection of the contents of luggage, travelcases, briefcases and the like usually renders the locks unsuitable for reuse, and unfortunately leaves the inspected bags unlocked, with their contents subject to pilfer and theft during travel and transport.

To accommodate the need of travelers for post-inspection luggage security while also accommodating the needs of government personnel to quickly and easily open and inspect selected and suspect bags that are secured by combination operated locks, a proposal was advanced by an entity known as Travel Sentry for providing government personnel with so-called "override keys" for nondestructively opening consumer owned, combination operated locks that have built-in "key override" features.

In accordance with the proposal of Travel Sentry, combination operated locks having a "key override" capability have been sold by many lock manufacturers. These locks may be purchased by consumers for locking their luggage, travelcases, briefcases and the like, or may be installed on luggage, travelcases, briefcases and the like by the manufacturers thereof. If the locked travel bags, briefcases and the like are inspected by government personnel, the locks are opened for inspection of contents using keys or key-like tools that are made available to and controlled by government authorized inspectors (but not to the owners of the locks), and then are relocked by the inspectors. Bags inspected and relocked in this manner are intended to have their contents secured by relocking them using the same combination operated locks that were used initially by the owners thereof.

SUMMARY OF THE INVENTION

The present application discloses lock embodiments that are well suited for use with travel bags, luggage and the like that each can be unlocked in a simple way known to the owner of the lock, typically by setting a particular combination, and that each can also be unlocked by a key or key-like tool controlled by government authorized inspectors. To signal that a key or key-like tool has been used, each lock has an indicator that responds to usage of a key or key-like tool.

In some lock embodiments disclosed herein, the indicator can be reset only after the lock is unlocked using the combination mechanism. In some embodiments the indicator is designed to be automatically reset when the lock is unlocked by using the lock's combination mechanism.

In some lock embodiments disclosed herein, the lock is a padlock having a shackle that is defined, at least in part, by a flexible cable.

In some disclosed embodiments, the indicator is visual in nature, displaying one pattern, color or other characteristic of appearance if the lock has not been opened by use of a key mechanism of the lock, and displaying a different pattern, color or other characteristic of appearance if the lock has been opened by use of the combination mechanism of the lock.

In some disclosed embodiments, locks are provided with indicators that normally display a first state, such as the color "green," when the locks have not been opened by keys, and that display a second state, such as the color "red" once a key has been used with an associated lock. In some embodiments, the second state continues to be displayed until the indicator is deliberately reset by the owner of the associated lock, typically at a time after the owner opens the lock using a procedure or technique known only by or available only to the lock owner, not to those who open the lock by use of a key.

In some disclosed embodiments, a housing-defined aperture or window is provided through which an indicator protected by the housing can be viewed—typically an indicator that is movable within the confines of the housing between first and second positions wherein a first surface portion of the indicator is displayed for viewing through an aperture or window when the indicator is in the first position, with a second surface portion being displayed for viewing through the aperture or window when the indicator is in the second position.

In each of the lock embodiments disclosed herein, all that is required for the lock's indicator to provide a "key has been used" signal is for the lock to be unlocked by a key mechanism of the lock. Resetting of the indicator may only require that the lock be unlocked using a combination mechanism of the lock, or may also require that a movable component of the lock be moved in a particular way.

In each of the lock embodiments disclosed herein, government inspectors or others who possess a key or key-like tool that will unlock the lock, but not a combination that will unlock the lock, are prevented from resetting the lock's indicator.

BRIEF DESCRIPTION OF THE DRAWINGS

These and other features, and a fuller understanding may be had by referring to the following description and claims taken in conjunction with the accompanying drawings, wherein:

DETAILED DESCRIPTION

I. The Padlock 100 of FIGS. 1-19

Figure 1:
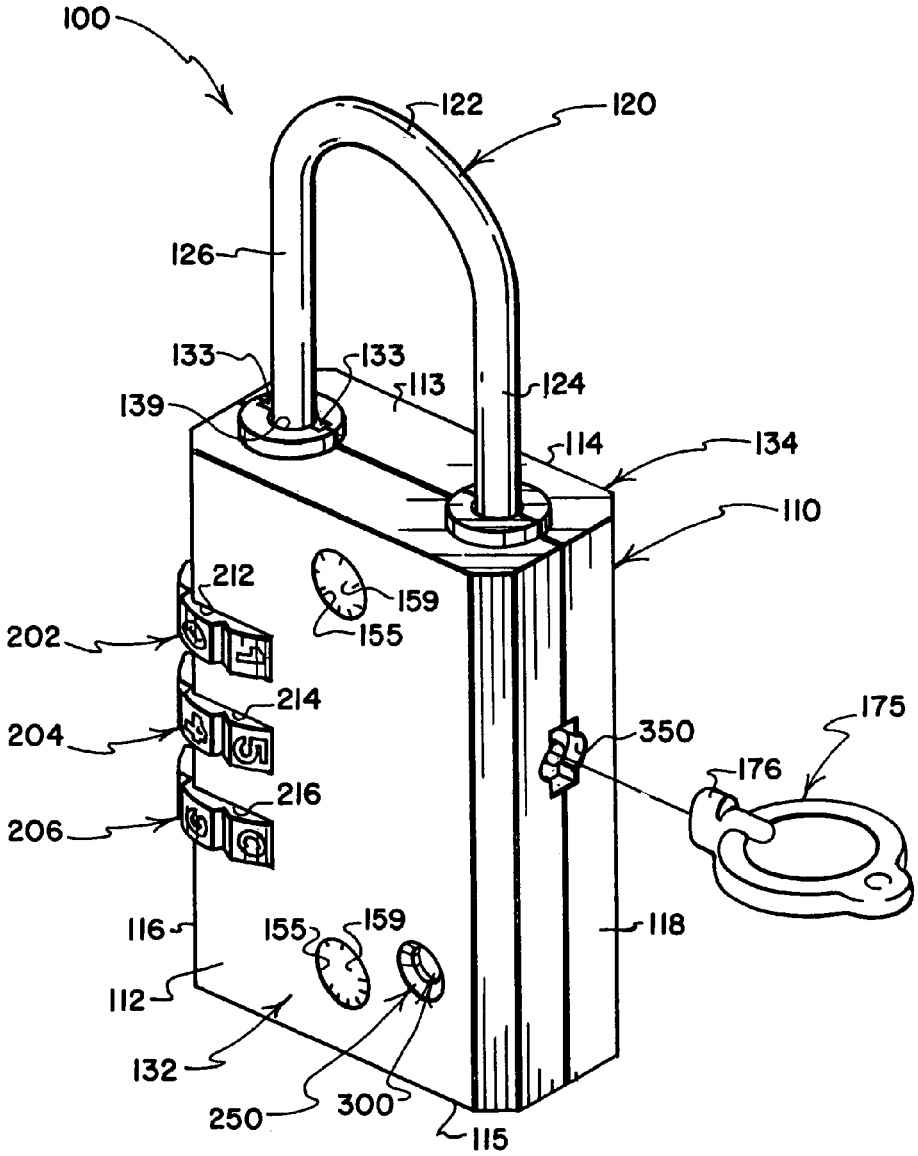
FIG. 1 is a perspective view showing a first embodiment of a combination and key operated padlock having an indicator surface that is visible through an aperture or window formed through a front wall of a housing of the padlock, with a shackle of the padlock in a locked position, and with a key positioned for insertion into a keyhole defined by a right side wall of the padlock.

Referring to FIG. 1, a padlock that may be operated either by entering a combination or by using a key 175 is indicated generally by the numeral 100. The padlock 100 has a housing 110 that, for purposes of illustration, takes a generally rectangular form; and a shackle 120 that, for purposes of illustration, takes a relatively short, generally U-shaped form. While the housing 110 is depicted as being of generally rectangular shape, and while the shackle 120 is depicted as being of relatively short, generally U-shaped configuration, those who are skilled in the art will readily understand that the housing need not take the relatively conventional, substantially rectangular shape that is shown, and that the shackle 120 may be substantially longer, or shorter, or may take other than a U-shaped configuration while still providing a padlock that incorporates indicator features such as are disclosed herein.

The housing 110 has opposed front and rear walls 112, 114; opposed top and bottom walls 113, 115; and opposed left and right side walls 116, 118. The shackle 120 has a U-shaped bend 122 that joins a relatively short leg 124 and a relatively long leg 126 that extends parallel to the shorter leg 124. The relatively longer nature of the leg 126 and the relatively shorter nature of the leg 124 of the shackle 120 are well illustrated in FIG. 2, where internal features of components of the padlock 100 also are shown.

Figure 2:
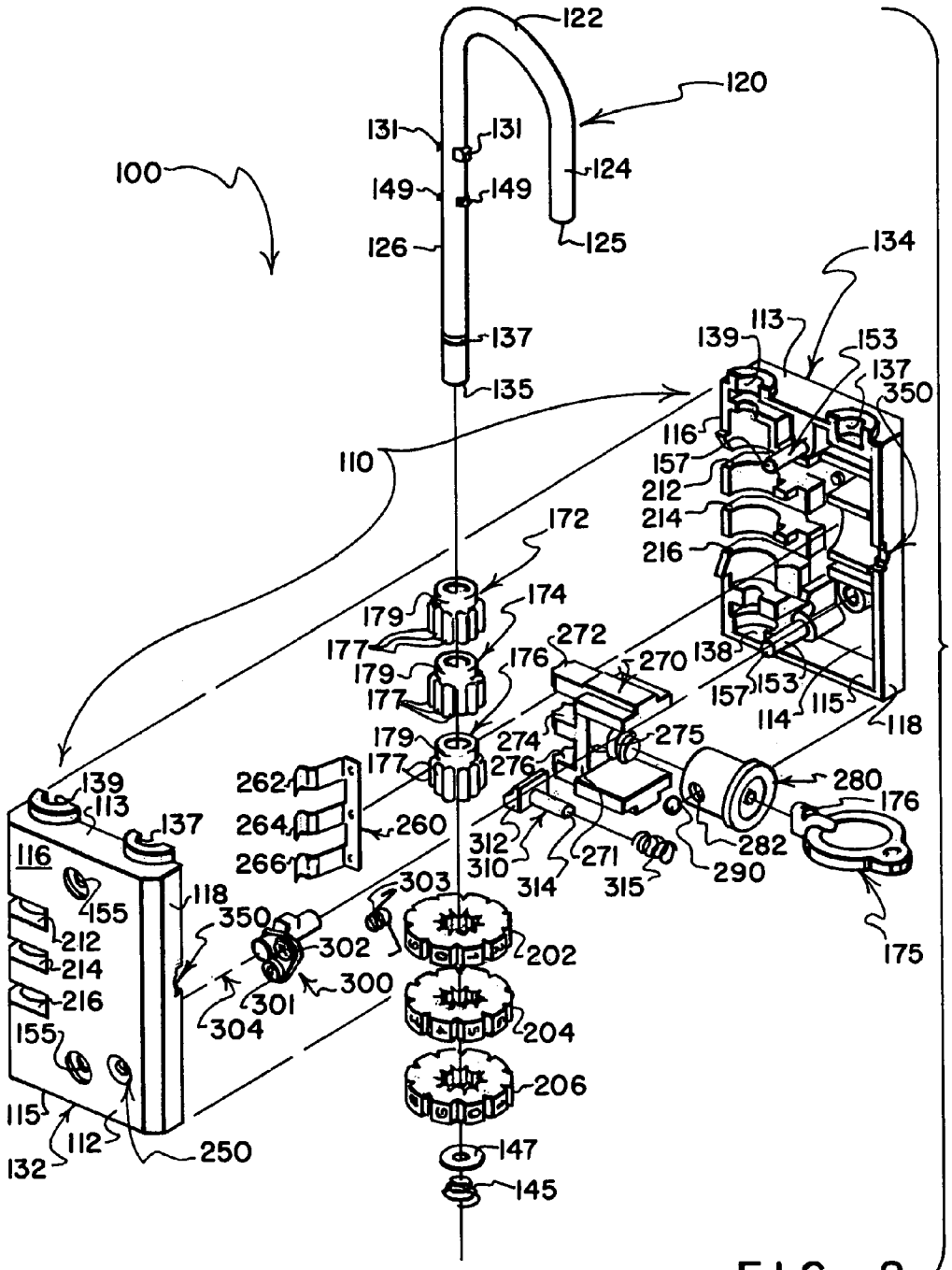
FIG. 2 is an exploded perspective view showing two halves or shells of the padlock's housing separated, showing internal components of the padlock, and the key.
Figure 3:
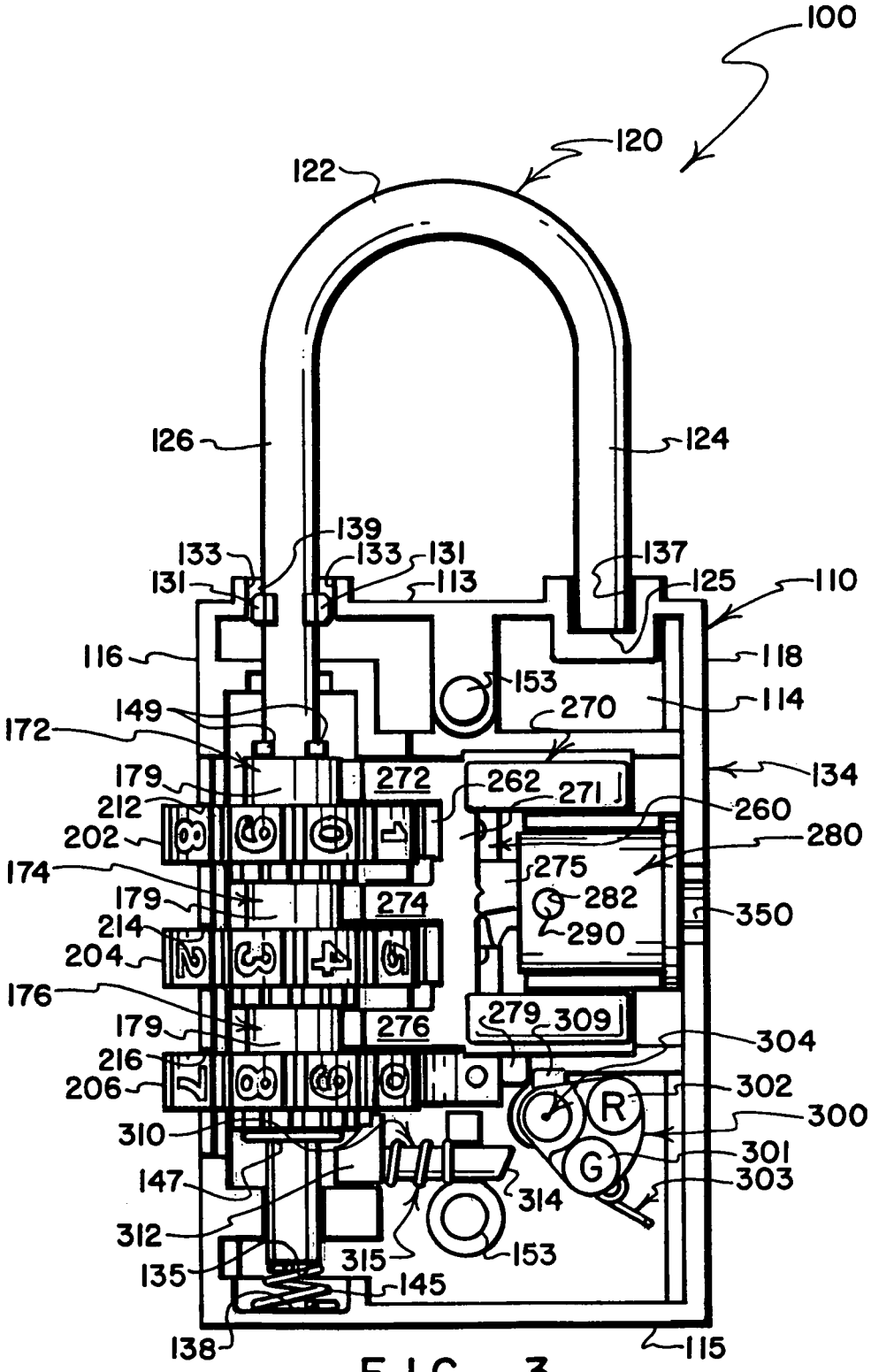
FIG. 3 is a front elevational view of components of the padlock with the front shell of the housing removed, with the shackle locked, and with the indicator positioned to display a first state, namely the color green.
Figure 5:
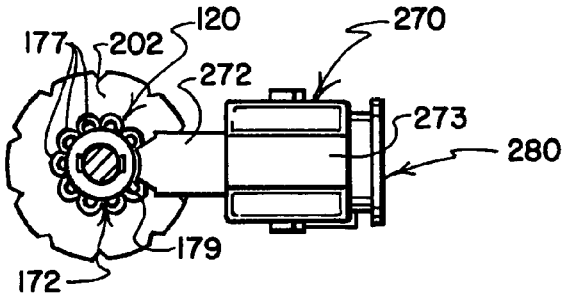
FIG. 5 is a sectional view as seen from a plane indicated by a line 5-5 in FIG. 4.
Figure 6:
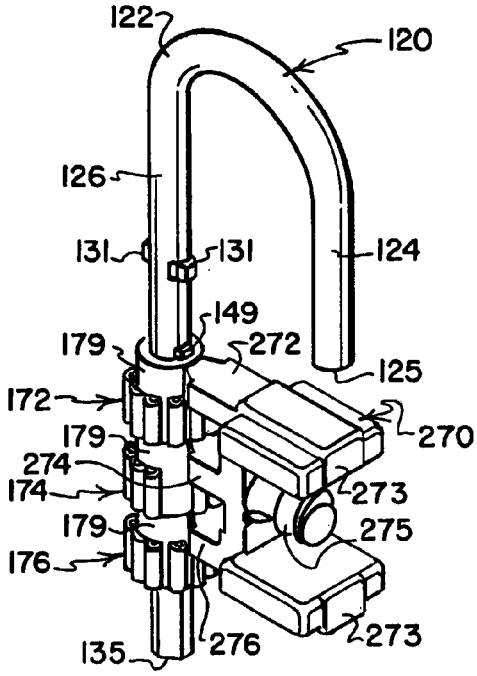
FIG. 6 is a perspective view of selected components of the padlock positioned as in FIGS. 3-5.
Figure 4:
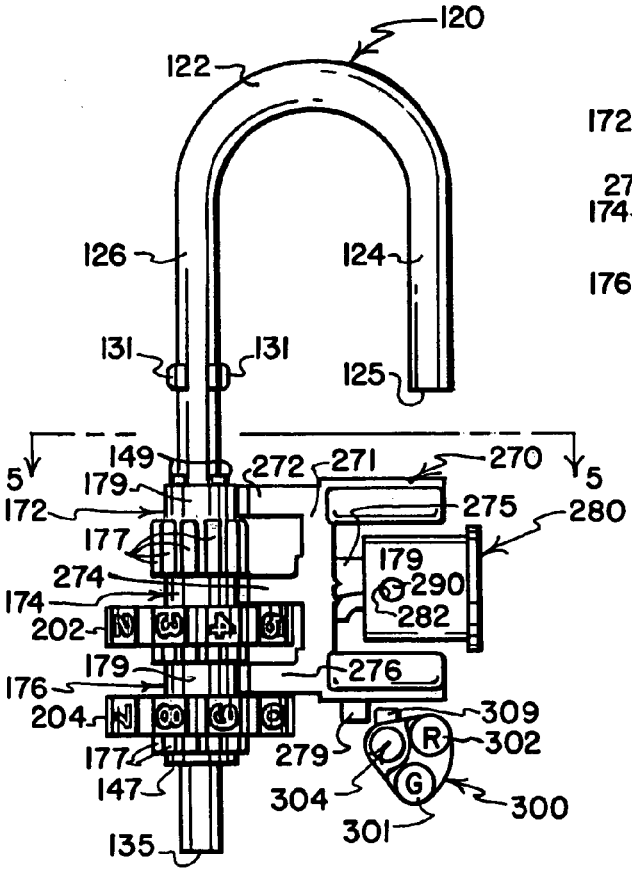
FIG. 4 is a front elevational view showing selected components of the padlock positioned as in FIG. 3.

Referring to FIGS. 2 and 3, the shorter leg 124 of the shackle 120 has a relatively flat bottom end region 125 that is configured to seat, when the padlock 100 is locked, within a shallow, upwardly facing recess 137 defined by the top wall 113 of the housing 110. The longer leg 126 of the shackle 120 extends through an opening 139 formed through the top wall 113 of the housing 110, and has a relatively flat bottom end region 135 that extends to a location relatively near, but spaced from, an inner surface portion 138 of the bottom wall 115 of the housing 110. A compression coil spring 145 is interposed between the bottom end region 135 of the longer leg 126 and the inner surface portion 138 of the bottom wall 115 of the housing so as to cause the shackle 120 to "pop up" (when the padlock is unlocked) to an unlocked position shown in FIG. 7 wherein the flat bottom end region 125 of the shorter leg 124 disengages the upwardly facing recess 137. When the shackle 120 has "popped up" from the locked position to the unlocked position of FIG. 3, the shackle 120 can be rotated about the axis of the longer leg 126 relative to the housing 110, for example to the half-turn unlocked position shown in FIG. 15.

Referring to FIGS. 1 and 2, externally viewable components of the padlock 100 include the front and rear shells 112, 114 of the housing; the U-shaped shackle 120; three identically configured, wheel-like dials 202, 204, 206 carried in spaced parallel-extending slots 212, 214, 216 that are defined by left side regions of the housing 110; a beveled indicator display window 250 formed through the front side wall 112 of the housing 110; and a keyhole 350 that extends through the right side wall 118 of the housing 110 at a location about mid-way along a vertical line of juncture of portions of the front and rear shells 132, 134 that cooperate to define the right side wall 118. The keyhole 350 is configured to receive an end region 176 of the key 175. After the end region 176 of the key 175 is inserted into the keyhole 350, the key 175 can be turned to unlock the shackle 120 of the padlock 100 for movement from the locked position of FIGS. 1 and 3 to the unlocked position of FIG. 7.

In preferred practice, the padlock 100 preferably is comprised of only about twenty separately formed parts. Referring principally to FIG. 2, these twenty parts include the front and rear shells 132, 134 of the housing 110; the shackle 120; the compression coil spring 145 that engages the lower end region of the longer leg 126 of the shackle 120 when the shackle 120 is locked, so as to bias the shackle 120 upwardly to "pop up" to an unlocked position whenever such movement is permitted by other components of the lock 100 either by setting a correct combination using the dials 202, 204, 206 or by inserting and turning the key 175; three identically configured sleeves 172, 174, 176 that have external teeth 177 that normally engage internal teeth 187 of the three identically configured dials 202, 204, 206; a leaf spring 260 which has three arms 262, 264, 266 that press against the peripheries of the dials 202, 204, 206 to assist in retaining the dials 202, 204, 206 in their current positions; a retaining washer or spring steel retaining clip 147 that resides in a groove 137 formed in the longer leg 126 of the shackle 120; a slide member 270 that has three leftwardly projecting fingers 272, 274, 276 configured to normally overlie at least some of the teeth 177 of the toothed sleeves 172, 174, 176, and to engage hub portions 179 of the sleeves 172, 174, 176 when the lock 100 is locked, with the slide member 270 also having a vertically extending formation 271 that interconnects the fingers 272, 274, 276 and a pair of vertically spaced slide portions 273 configured to engage suitably configured internal portions of the housing shells 132, 134 to enable the slide member 270 to slide leftward and rightly so the fingers 272, 274, 276 can move into and out of engagement with the smooth hub portions 179 of the externally toothed sleeves 172, 174, 176, and with the slide member 270 also having a centrally located formation that projects rightwardly from the vertically extending formation 271 to define a spiral groove or spirally grooved surface 275 (best seen in FIG. 12) that is surrounded by a hollow left portion of a cylinder 280 (as is best seen in FIG. 12); a steel ball 290 that is carried in a hole 282 formed through hollow left portions of the cylinder 280 (as is best seen in FIG. 12) and which drivingly engages the spirally grooved surface 275 of the slide 270 to establish a one-way driving connection between the cylinder 280 and the slide 270 that permits rotation of the cylinder 280 to move the slide 270 rightwardly and leftwardly relative to the housing 110 (between a normal position of the slide 270 shown in FIGS. 3-5, 7-10, 16 and 17, and a key-unlocked position of the slide 270 shown in FIGS. 11-14) as the ball 290 moves along the spirally grooved surface 275 of the slide 270, but which does not permit the slide 270 to move rightwardly and leftwardly on its own so as to cause rotation of the cylinder 280; an indicator 300 that is supported internally within the housing 110 for pivotal movement about an axis 304 between first state and second state positions wherein the indicator 300 presents one or the other of a first state surface 301 (which typically displays the color "green") and a second state surface 302 (which typically displays the color "red") to the indicator window 250 of the housing 110; a torsion spring 303 that is interposed between the housing 110 and the indicator 300 for biasing the indicator toward one or the other of its first state or second state positions; and, a reset member 310 that is supported internally within the housing 110 for leftward and rightwardly movement, and that is biased leftwardly by a compression coil spring 315.

Referring to FIG. 2, the front and rear housing shells 132, 134 are held together by pin-like projections 153 of the rear shell 134 that extend through holes 155 formed in the front shell 132. Outer end regions 157 of the pin-like projections 153 are riveted or clenched (as is indicated by the numerals 159 in FIG. 1) after the front and rear shells 132, 134 have been assembled with internal components of the padlock 100 protectively housed therebetween, to permanently clamp the front and rear housing shells 132, 134 together.

Interior features of the front housing shell 132 substantially mirror the interior features of the rear housing shell 134 that are depicted in FIGS. 2, 3, 7, 11 and 15-17, except for the pin-like projections 153 of the rear shell 134 that are received in the openings 155 of the front shell 132. Protectively enclosed within passages, chambers or compartments that are cooperatively defined by interior portions of the front and rear housing shells 132, 134 are the majority of the parts that comprise the padlock 100, several of which are movable relative to the housing 110 as described herein.

Figure 16:
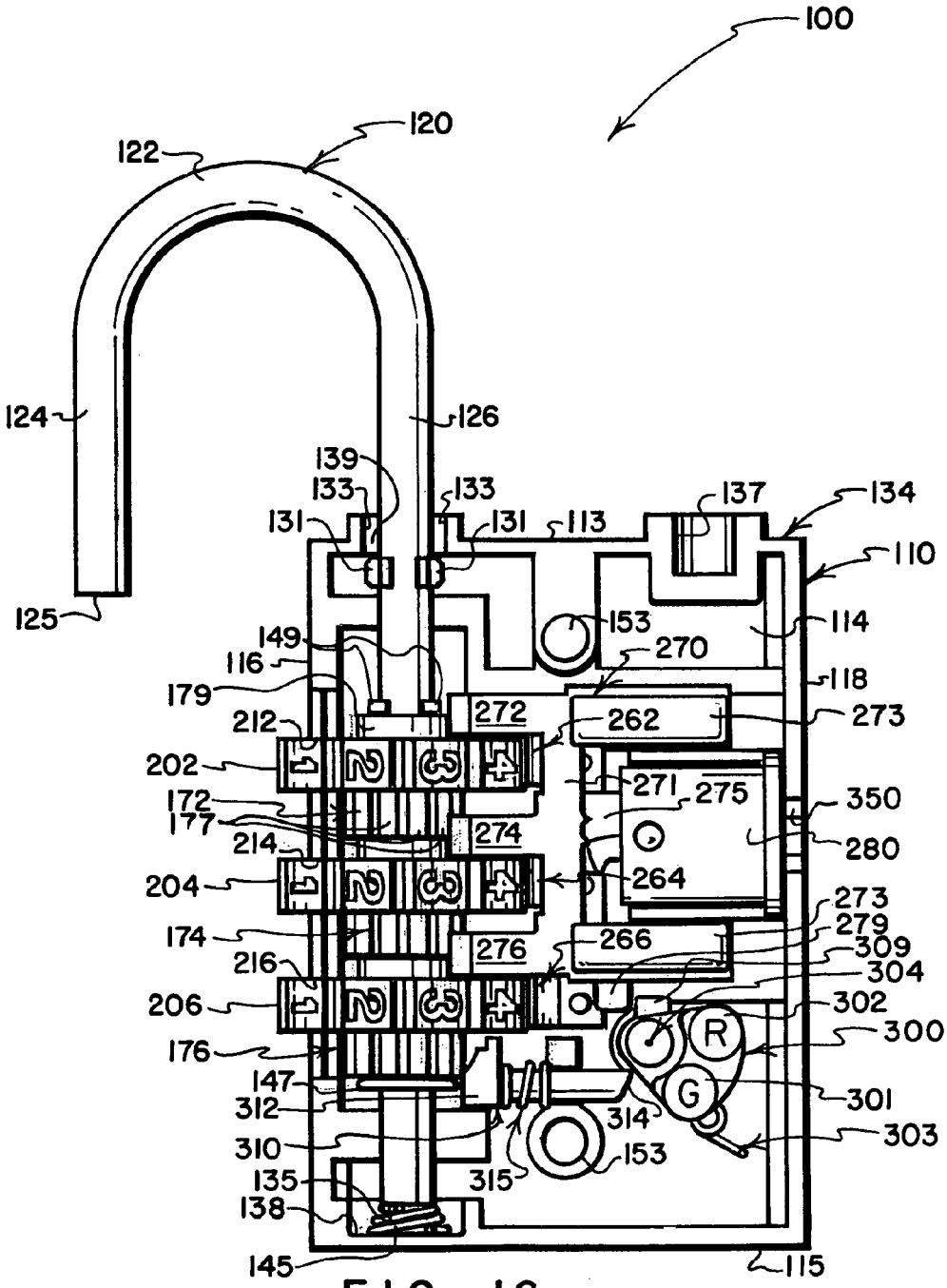
FIG. 16 is a front elevational view showing selected components of the padlock with the front shell of the housing removed, with the components as they appear near the completion of a shackle manipulation procedure that is employed by the owner of the padlock to reset the indicator, more specifically with the shackle depressed while in the half-turn orientation of FIG. 15, and with the indicator having been reset due to the depression of the shackle so as to display the first state (typically the color "green")
Figure 17:
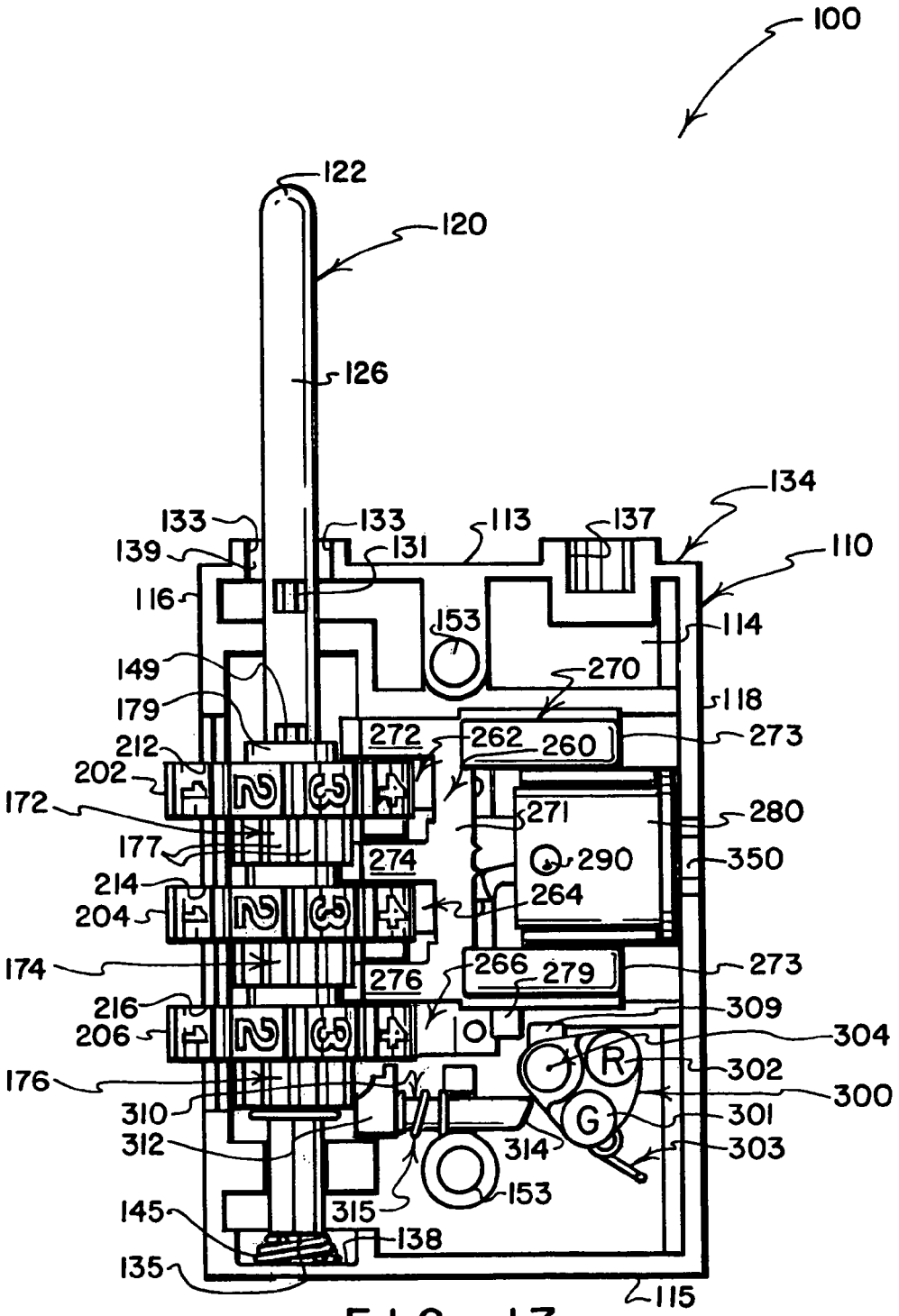
FIG. 17 is a front elevational view showing selected components of the padlock with the front shell of the housing removed, with the components as they are positioned for permitting the combination of the padlock to be changed, with the shackle having been turned a quarter turn after first having been turned to the half-turn position of FIG. 15 and after second having been depressed to the indicator reset position of FIG. 16.
Figure 18:
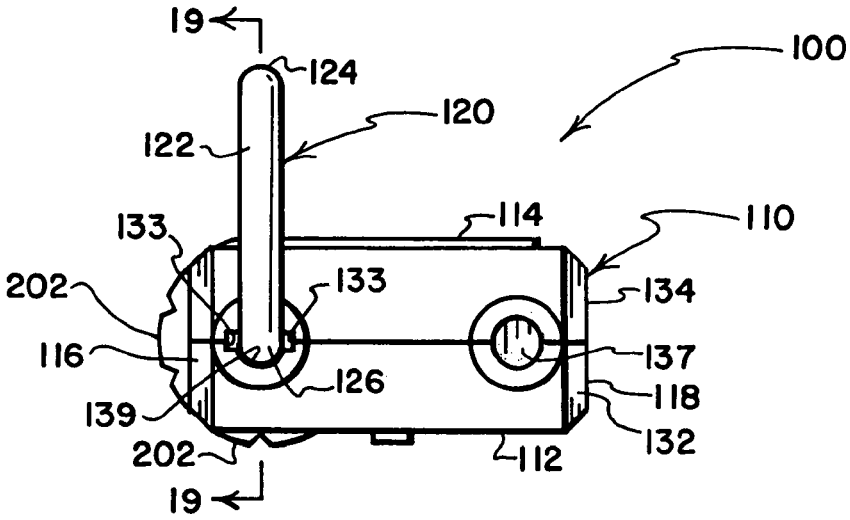
FIG. 18 is a top plan view of the padlock with the components thereof positioned as in FIG. 17.
Figure 19:
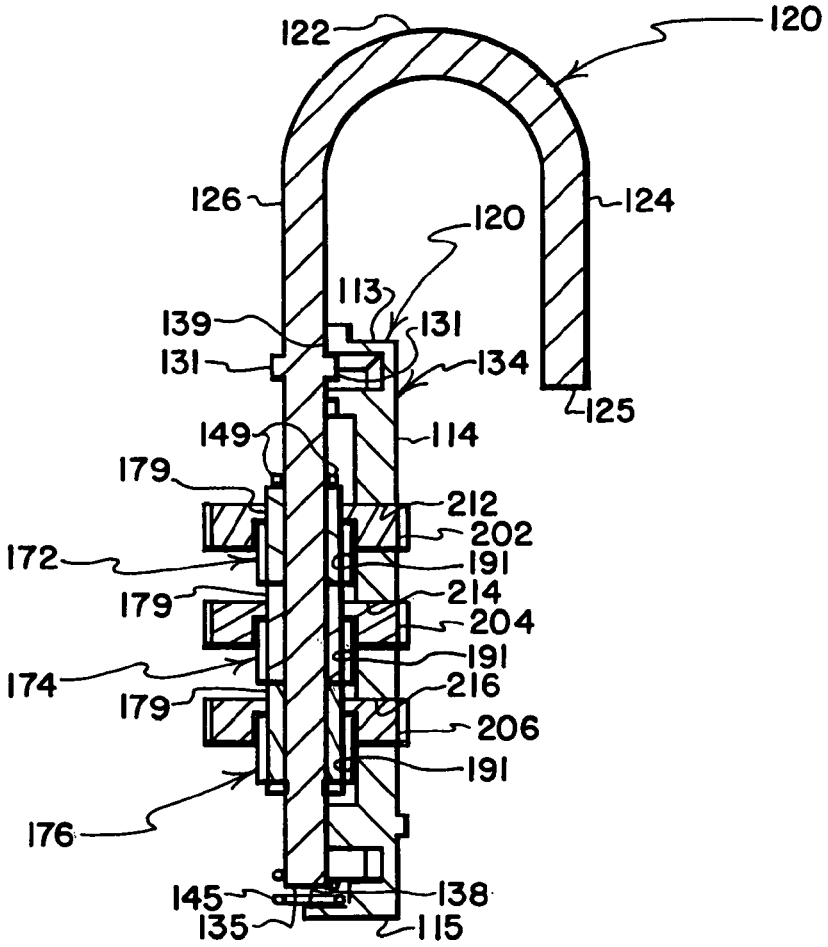
FIG. 19 is a cross-sectional view of selected components of the padlock as seen from a plane indicated by a line 19-19 in FIG. 18.

Except when the shackle 120 of the lock 100 is depressed for purposes either of resetting the indicator 300 of the lock 100, or resetting the combination of the lock 100, the teeth 187 of the internally toothed regions 203, 205, 207 of the dials 202, 204, 206 always drivingly engage the teeth 177 of the toothed sleeves 172, 174, 176. Disengagement of the teeth 187 from the teeth 177 occurs only when the longer leg 126 of the shackle 120 is depressed, as depicted in FIGS. 16, 17 and 19 sufficiently to 1) bring reduced diameter hub portions 179 of the sleeves 172, 174, 176 into a region surrounded by the internally projecting teeth 187 of the dials 202, 204, 206, and sufficiently to 2) bring enlarged, downwardly facing cavities 191 of the dials 202, 204, 206 into surrounding relationship with the radially outwardly projecting teeth 177 of the sleeves 172, 174, 176. Disengagement of the teeth 187 from the teeth 177 suspends the driving connection that normally exists between the dials 202, 204, 206 and the toothed sleeves 172, 174, 176. When the driving connection between the teeth 177, 187 is suspended, this permits the dials 202, 204, 206 to be rotated relative to the toothed sleeves 172, 174, 176 so that a new combination for operating the lock 100 can be set.

Figure 9:
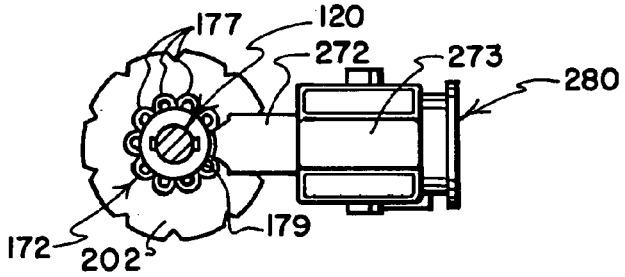
FIG. 9 is a sectional view as seen from a plane indicated by a line 9-9 in FIG. 8.

Each of the toothed sleeves 172, 174, 176 has positions for ten equally spaced teeth 177, but only nine of these ten positions carry tooth formations 177. The fingers 272, 274, 276 of the slide 270 are configured to normally overlie one or more of the teeth 177 of the externally toothed sleeves 172, 174, 176; however, when the dials 202, 204, 206 are turned to set a correct combination for unlocking the lock 100, the fingers 272, 274, 276 are aligned with the unoccupied tooth positions of the toothed sleeves 172, 174, 176 (as depicted in FIG. 9) which permits the shackle 120 (and the toothed sleeves 172, 174, 176 which are carried by the longer shackle leg 126 at a location between the retaining washer or clip 147 and a crimped region 149 of the shackle) to be raised so that the flat bottom end region 125 of the shorter leg 124 of the shackle 120 no longer resides in the housing recess 137 (which is where the bottom end region 125 resides when the shackle 120 is closed—i.e., when the lock 100 is locked).

The externally toothed sleeves 172, 174, 176 are journaled for rotation at spaced locations along the longer leg 126 of the U-shaped shackle 120. Also journaled for rotation at spaced locations along the longer leg 126 are the dials 202, 204, 206. While the toothed sleeves 172, 174, 176 move upwardly and downwardly as the longer leg 126 of the shackle 120 moves upwardly and downwardly to unlock and lock the lock 100, the dials 202, 204, 206 do not move upwardly and downwardly, for the dials project through the slots 212, 214, 216 of the housing 110 and therefore cannot move vertically with respect to the housing 110.

Figure 15:
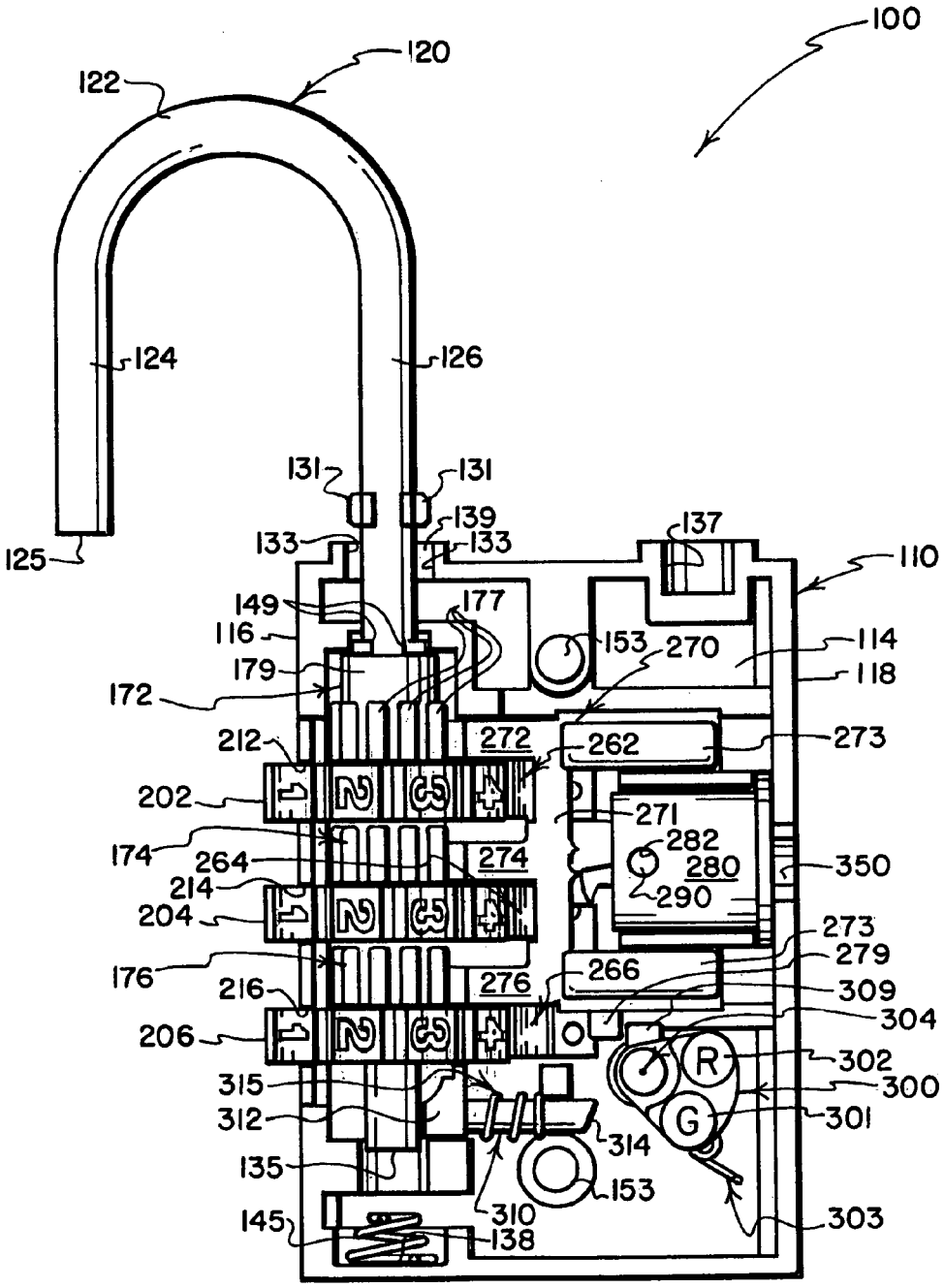
FIG. 15 is a front elevational view showing selected components of the padlock with the front shell of the housing removed, with the components as they appear mid-way through a shackle manipulation procedure that is employed by the owner of the padlock to reset the indicator from displaying the second state (typically the color "red") to displaying the first state (typically the color "green"), more specifically with the shackle having been unlocked (by entering a correct combination using the three dials of the padlock at a time after the indicator has been moved to display its second state color "red" as the result of the padlock's previously having been opened using a key), and with the shackle turned a half turn relative to the housing.

The longer leg 126 of the shackle 120 is crimped not only at a location (discussed previously and identified by the numeral 149) but also at a slightly higher location where opposed projections 131 are formed on the longer leg 126 by pinching or crimping the material of the longer leg 126. The opposed projections 131 align with widened portions 133 of a top wall opening 139 (of the housing 110 through which the longer leg 126 of the shackle 120 extends) when the shorter leg 124 of the shackle 120 is in either of two positions, namely 1) when the shorter leg 124 of the shackle 120 is aligned with the recess 137 (as depicted in FIGS. 3, 7 and 11, or 2) when shackle 120 is half-turned around (as depicted in FIGS. 15 and 16) such that the shorter leg 124 of the shackle 120 is as far away as it can get from the recess 137. At all other orientations of the shackle 120 relative to the housing 110, for example in the quarter-turned orientation depicted in FIG. 17) the opposed projections 131 are out of alignment with the widened portions 133 of the top wall opening 139.

The alignment and non-alignment of the projections 131 with the widened portions 133 of the top wall opening 139 determine whether and when the shackle 120 can be raised or depressed relative to the housing 110. In the locked position of the shackle 120 shown in FIG. 3, it will be seen that the projections 131 have moved into the widened portions 133 of the top wall opening 139 when the shackle 120 was depressed to its locked position (i.e., a position wherein the bottom end region 125 of the shorter leg 124 of the shackle 120 is seated within the recess 137 formed in the top wall 113 of the housing 110). When the shackle 120 moves from the locked position shown in FIG. 3 to the unlocked position shown in FIG. 7, it will be seen that the projections 131 move back out of the widened regions 133 of the top wall opening 139 to a position above the top wall 113—which permits the shackle 120 to be pivoted about the axis of the longer leg 126.

When the shackle 120 has been pivoted to the half-turn position illustrated in FIG. 15, it will be seen that the projections 131 again align with the widened regions 133 of the top wall opening 139, which means that the shackle 120 can be depressed to a position illustrated in FIG. 16 wherein the projections 131 have moved completely through the top wall opening 139 and into a space located just beneath the top wall 113—a space wherein the projections 131 do not inhibit turning of the shackle 120, hence the shackle 120 can again be pivoted about the axis of the longer leg 126, for example to the quarter turn position illustrated in FIG. 17. As will be explained in greater detail shortly, the half-turn, shackle depressed position illustrated in FIG. 16 is what is required to reset the indicator 300 from displaying its second state surface 302 (typically of the color "red") to displaying through the indicator window 250 the first state surface 301 (typically of the color "green"). And, as will be explained in greater detail shortly, the quarter-turn, shackle depressed position illustrated in FIG. 17 is an appropriately safe position for the shackle 120 to assume when the combination of the padlock 100 is to be reset.

Referring to FIG. 12, the cylinder 280 has a hollow left end region that surrounds the spirally grooved surface 275 of the slide 270, and has a hollow right end region that defines a suitably configured formation or formations, indicated generally by the numeral 285, configured to be drivingly engaged by the left end region 176 of the key 175 (after the left end region 176 of the key 175 has been inserted through the keyhole 350 of the housing 110) so that the key 175 can be turned to effect a corresponding, concurrent turning movement of the cylinder 280 to move the ball 190 around the spiral groove 275 of the slide 270 to move the slide 270 rightwardly, away from the normal position of the slide 270 wherein the fingers 272, 274, 276 of the slide 270 overlie some of the tooth formations 177 of the externally toothed sleeves 172, 172, 174. When the slide 270 is moved rightwardly from its normal position wherein its fingers 272, 274, 276 overlie some of the teeth 177 (as depicted in FIGS. 4-10) to a key-unlocked position (as depicted in FIGS. 11-14), the fingers 272, 274, 276 no longer overlie any of the teeth 177 and therefore no longer obstruct upward unlocking movement of the shackle 120 (which causes the toothed sleeves 172, 174, 176 to move upwardly with the shackle 120) when the shackle 120 is popped up to the unlocked position of FIG. 11 under the influence of the spring 145 which acts on the flat lower end region 135 of the longer leg 126 of the shackle 120.

The series of movements described just above (which is initiated by inserting and turning the key 175 in the housing 110 to cause the cylinder 280 to rotate to rightwardly move the slide 270 so that the fingers 272, 274, 276 no longer overlie the teeth 177 hence the shackle 120 is caused to pop up to the unlocked position under the influence of the spring 145) describes how the padlock 100 is unlocked by using the key 175. A reverse procedure is followed to relock the shackle 120 after the lock 100 has been opened by the key 175. To carry out the relocking of the lock 100 after the lock 100 has been opened by the key 175, the shackle 120 is depressed while the key 175 still is in the turned position (i.e., while the key 175 still is inserted into the keyhole 350 and still is turned as is required to cause the slide 270 to move rightwardly so that the fingers 272, 274, 276 no longer obstruct downward or upward movement of the longer leg 126 of the shackle 120 which carries the toothed sleeves 172, 174, 176) to bring the shackle to the locked position wherein the bottom end region 125 of the shorter leg 124 of the shackle 120 is seated in the top wall recess 137. The key 175 is then reverse-turned to move the slide 270 leftwardly to the normal position of the slide 270 wherein the fingers 272, 274, 276 overlie some of the teeth 177 of the toothed sleeves 172, 174, 176, and the key 175 then is removed from the keyhole 350.

Because the steel ball 290 establishes a one-way driving connection between the cylinder 280 and the slide 270 (that permits rotation of the cylinder 280 by the key 175 to move the slide 270 leftwardly and rightwardly within the confines of the housing 110, but does not permit the slide 270 to move leftwardly or rightwardly on its own so as to rotate the cylinder 280), the cylinder 280 does not rotate out of the position it normally occupies (wherein its formation 285 is ready to be drivingly engaged by the key's end region 176 anytime the end region 176 is inserted through the keyhole 350), and the slide 270 does not move rightwardly out of its normal position wherein its fingers 272, 274, 276 overlie some of the teeth 177 so as to obstruct the upward movement of the shackle 120, thus the lock 100 remains locked until either a correct combination is entered on the dials 202, 204, 206, or the key 175 is inserted and turned so as to rotate the cylinder 280 to move the slide 270 rightwardly to unlock the shackle 120.

The indicator member 300 can pivot relative to the housing 110 to selectively expose either the first state surface 301 (that preferably is colored "green") or the second state surface 302 (that preferably is colored "red") to be viewed through the indicator window 250 of the housing 110. The torsion coil spring 303 is arranged to serve what is well known to those skilled in the art as an "over center" function, meaning that the spring 303 either biases the indicator 300 toward its first state position (typically displaying the color "green" through the indicator window or opening 250 defined by the housing 110) as shown in FIGS. 3, 4, 7 and 8, or toward its second state position (typically displaying the color "red" through the indicator window or opening 250) as shown in FIGS. 11 and 12.

Figure 7:
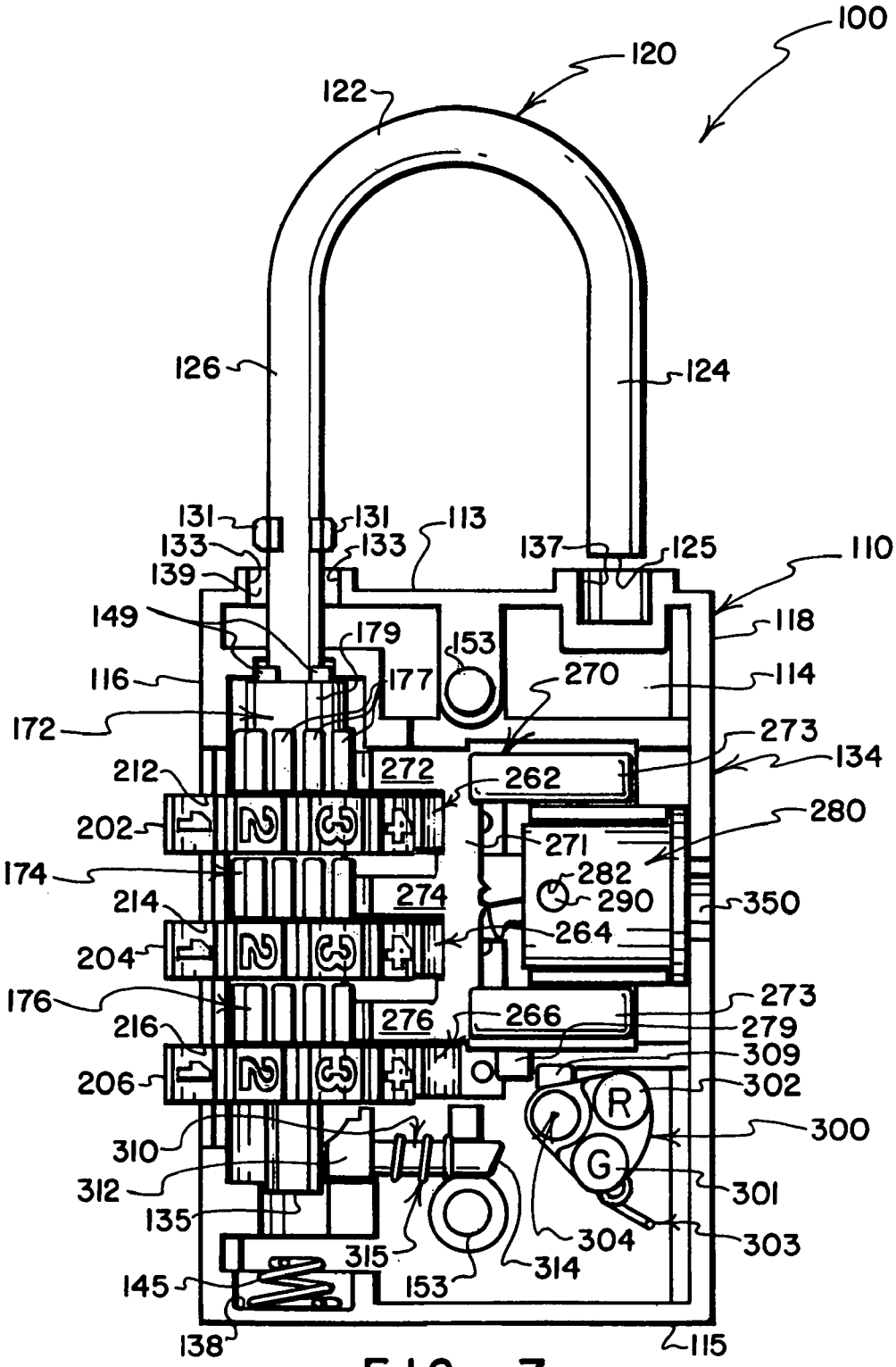
FIG. 7 is a front elevational view showing selected components of the padlock with the front shell of the housing removed, with the shackle unlocked as the result of entering a correct combination using the three dials of the padlock, and with the indicator still positioned to display a first state, namely the color green.
Figure 11:
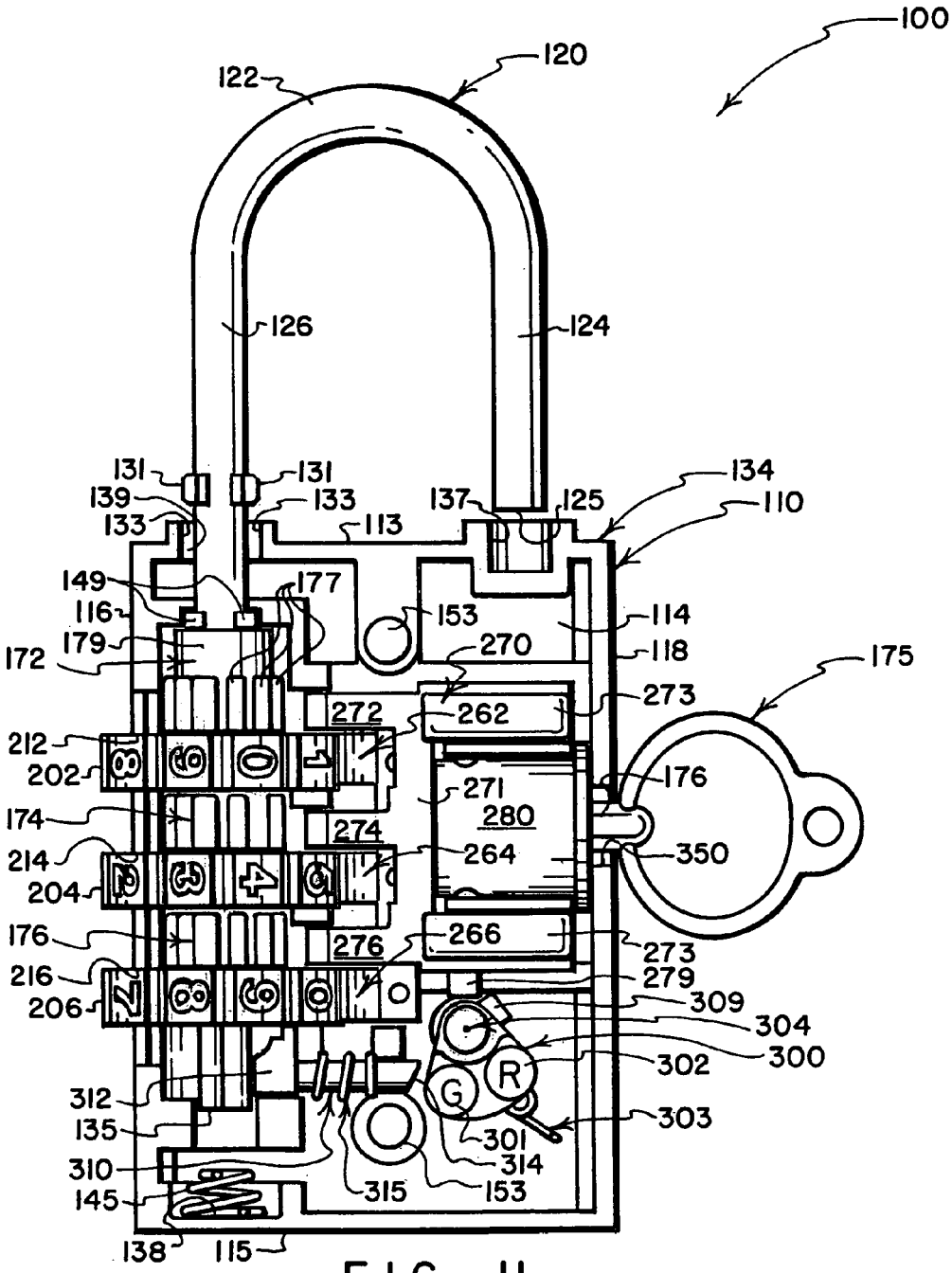
FIG. 11 is a front elevational view showing selected components of the padlock with the front shell of the housing removed, with the shackle unlocked as the result of inserting the key into the keyhole of the housing and turning the inserted key, and with the indicator moved (as the result of the key being turned) to display a second state, namely the color red.
Figure 13:
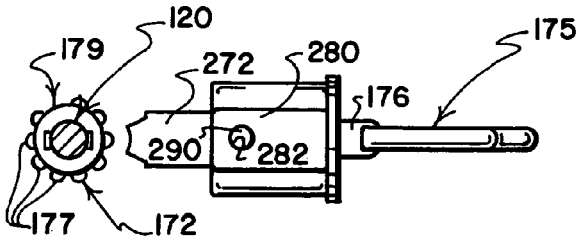
FIG. 13 is a sectional view as seen from a plane indicated by a line 13-13 in FIG. 12.
Figure 14:
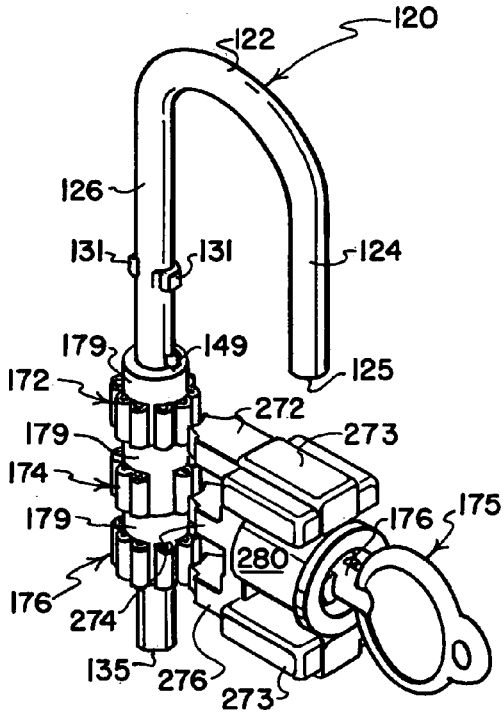
FIG. 14 is a perspective view of selected components of the padlock positioned as in FIGS. 11-13.
Figure 12:
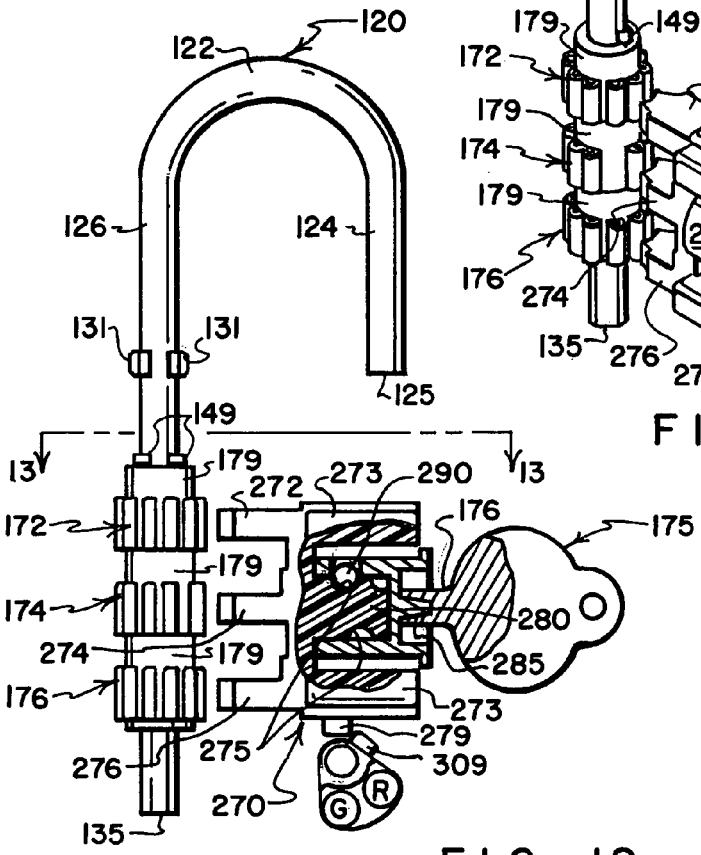
FIG. 12 is a front elevational view showing selected components of the padlock positioned as in FIG. 11, with portions of selected components broken away and shown in cross-section.

The indicator member 300 is caused to pivot from its normal state one position, depicted in FIGS. 3, 4, 7 and 8, to its state two position, depicted in FIGS. 11 and 12, by a depending tab 279 of the slide 270 which engages an upwardly projecting tab 309 of the indicator member 300. In FIGS. 3 and 7 it will be seen that the tabs 279, 309 will engage if the slide 270 is moved rightwardly if caused to do so by inserting and turning the key 175 so as to rotate the cylinder 280. In FIGS. 11 and 12 it will be seen that engagement of the tabs 279, 309 has caused the indicator member 300 to pivot about the axis 304 as the slide 270 has been moved rightwardly as the result of the key 175 being inserted and turned.

To reset the indicator member 300 from the second state position shown in FIGS. 11 and 12 to the normal first state position shown in FIGS. 3, 4, 7 and 8, the reset member 310 has a bar-shaped portion 312 with an enlarged head formation 312 at the left end of the bar-shaped portion 312, and with the head formation 312 being configured to be engaged when the shackle 120 is depressed after being half-turned (see FIGS. 15 and 16 which shows the shackle 120 before and after being depressed while in the half-turned position), which engagement causes the reset member 310 to be slided rightwardly along the axis of the bar-shaped portion 312 so that a right end region 314 of the bar-shaped portion 312 engages and pivots the indicator member 300 from the second state position depicted in FIGS. 11 and 12 to the first state position depicted in FIGS. 3, 4, 7 and 8. Depression of the shackle 120 as in FIG. 16 brings into engagement with a leftwardly facing cam surface of the enlarged head formation 312 of the reset member 310 one or more of 1) lower end portions of the shackle leg 126, 2) lower portions of the washer-like retaining clip 147, or 3) lower portions of the toothed sleeve 176—which engagement causes the indicator reset member 310 to move rightwardly in opposition to the action of the compression coil spring 315 which is interposed between the housing 110 and the enlarged head formation 312 of the reset member 310 so as to bias the reset member 310 leftwardly.

The reason why the indicator member 300 cannot be reset after the lock 100 has been opened utilizing the key 175 is because: 1) the slide 270 must be moved to the right (by keeping the turned key 175 in place in the lock housing 110) so that its fingers 272, 274, 276 will not obstruct the downward movement of the shackle 120 that is needed to cause the reset member 310 to move rightwardly to reset the indicator 300; and 2) if the slide 270 is moved to the right (as by keeping the turned key 175 in place in the lock housing 110) to permit downward movement of the shackle 120 to effect rightward movement of the reset member 310 to reset the indicator 300, the engagement of the tab 279 on the slide 270 with the tab 309 on the indicator 300 will retain the indicator 300 in its second state position thereby preventing rightward movement of the reset member 310 as the result of downward movement of the shackle 120—thus the indicator 300 cannot be reset while the key 175 remains turned in the lock 100, and the shackle 120 cannot be depressed to reset the indicator 300 after the lock 100 has been opened with the key 175 unless the slide 270 is moved rightwardly by the inserted and turned key 175. The only way the indicator 300 can be reset is by opening the lock 100 by using a correct combination so that, when the slide 270 is depressed to move the reset member 310 rightwardly, none of the downwardly moving teeth 177 of the sleeves 172, 174, 176 (that move downwardly with the shackle 120) will have their downward movement obstructed by the fingers 272, 274, 276 of the slide 270 that must be in its leftward position, otherwise the indicator 300 cannot be reset because the tabs 279, 309 of the slide 270 and the indicator 300 will engage to hold the indicator 300 in the second state position, preventing the resetting of the indicator 300 to the first state position.

In operation, starting with the shackle 120 of the padlock 100 in its closed or locked position as depicted in FIGS. 1 and 3, and starting with the indicator 300 displaying through the indicator window 250 the first state surface 301 (typically of the color "green"), the padlock 100 can be unlocked either by entering a predetermined combination (known to the owner of the lock 100) using the dials 202, 204, 206, or by inserting the key 175 into the keyhole 350 and turning the key 175.

Figure 10:
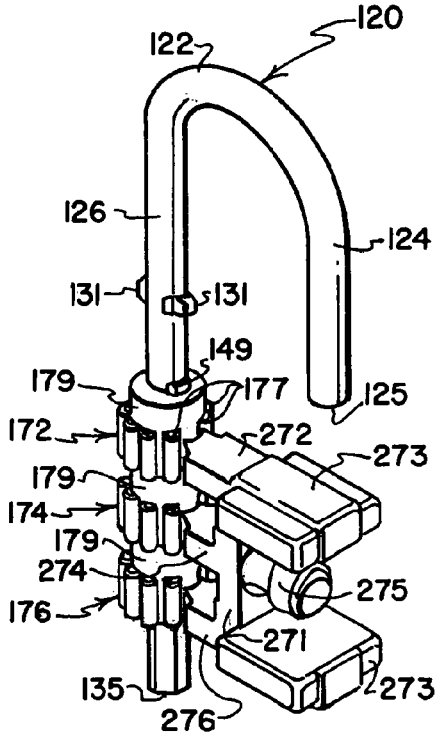
FIG. 10 is a perspective view of selected components of the padlock positioned as in FIGS. 7-9.
Figure 8:
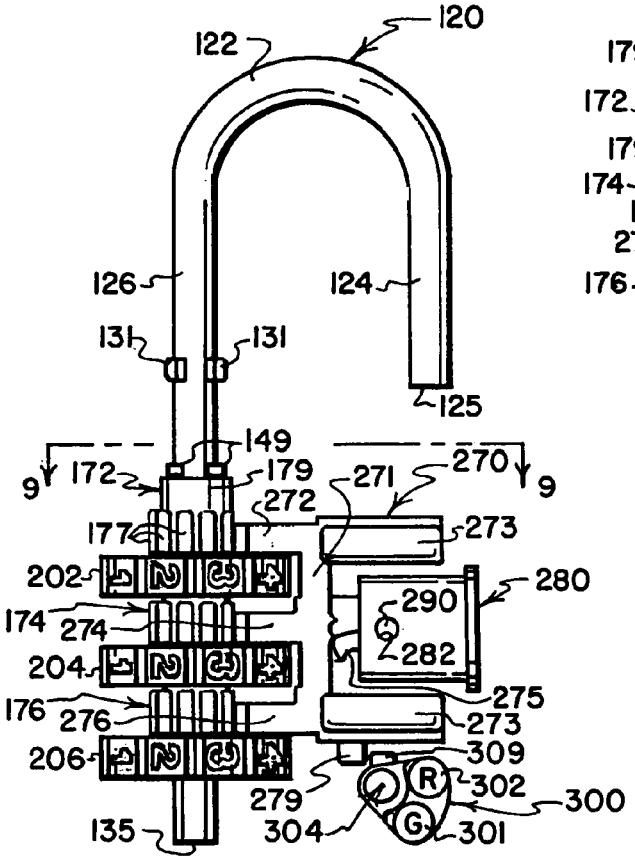
FIG. 8 is a front elevational view showing selected components of the padlock positioned as in FIG. 7.

Opening the padlock 100 by entering the combination involves nothing more than dialing in the combination using the dials 202, 204, 206—so that, when the correct numbers of the combination are aligned with an appropriate portion of the housing 110, the toothless or open-toothed positions of the externally toothed sleeves 172, 174, 176 are aligned with the fingers 272, 274, 276 of the slide 270—which permits the spring 145 to pop up the shackle 120 to the unlocked position of FIG. 7. The alignment of the toothless or open-toothed positions of the sleeves 172, 174, 176 with the fingers 272, 274, 276 is depicted in FIGS. 8-10 which also show that the shackle 120 has popped up relative to the dials 202, 204, 206 (which do not move vertically relative to the housing because the dials 202, 204, 206 are retained in slots 212, 214, 216 of the housing 110).

Once the shackle 120 of the padlock 100 has been opened as by entering a correct combination in the manner just described, any one of three actions can be taken. First, and most obviously, the shackle 120 can be relocked as by depressing the shackle 120 and rotating the dials 202, 204, 206 so that the fingers 272, 274, 276 no longer align with the toothless or open-toothed positions of the toothed sleeves 172, 174, 176. The lock 100 stays locked because the fingers 272, 274, 276 overlie at least some of the teeth 177 of the sleeves 172, 174, 176 which prevents the sleeves 172, 174, 176 (and hence the shackle 120 on which the sleeves 172, 174, 176 are mounted) from moving upwardly to an unlocked position.

A second action that can be taken when the shackle 120 has been opened by entering a correct combination using the dials 202, 204, 206, is to reset the indicator 300 (if the indicator 300 has been moved to its second state position displaying through the window 250 the second state surface 302, typically the color "red"). To reset the indicator 300, the shackle 120 is turned to the half-turned position of FIG. 15 and is depressed as shown in FIG. 16 to cause the reset member 310 to move rightwardly as has been described above to engage and pivot the indicator 300 from its second state position back to its normal first state position wherein the first state surface 301 is displayed through the window 250 (typically the color "green"). Once the indicator 300 has been reset, the shackle 120 is raised and then rotated back so the shorter leg 124 has its lower end region 125 aligned with the housing recess 137 so that the shackle 120 then can be depressed to lock the lock 100.

A third action that can be taken when the shackle 120 has been opened by entering a correct combination using the dials 202, 204, 206, is to reset the combination that is to be employed to open the lock 100 the next time the lock 100 is locked. To do this, the shackle 120 is pivoted to the half-turned position shown in FIG. 15, the shackle 120 is depressed to the position shown in FIG. 16 (which also accomplishes the second action described just above of resetting the indicator 300 if the indicator 300 was displaying the second state surface 302 when the shackle 120 was depressed to the position shown in FIG. 16), and then turning the depressed shackle 120 to the quarter-turned position depicted in FIG. 17.

When the depressed shackle 120 is turned a quarter turn from the depressed shackle position shown in FIG. 16 to the depressed shackle position shown in FIG. 17, it is safe to turn the dials 202, 204, 206 to line up a new combination for operating the padlock 100 the next time that the lock 100 is locked. Actually, the dials 202, 204, 206 could be turned to set a new combination while the shackle 120 is depressed to the position shown in FIG. 16; however, this is a relatively unsafe thing to do for, if the shackle 120 should pop up (under the influence of the spring 145 that acts on the flat bottom end region 135 of the longer leg 126 of the shackle 120), the dials 202, 204, 206 might be caused to set a combination that is unknown to the owner of the lock—a combination that might need to be discovered by endlessly turning the dials 202, 204, 206 while trying many or all of the set of combinations that includes every possible combination that can be set on the lock 100.

What permits the combination to be reset when the shackle 120 is depressed as shown in FIGS. 16 and 17 is that the teeth 177 are disengaged from the teeth 187 during such depression of the shackle 120, which means that the dials 202, 204, 206 may be turned freely without causing corresponding turning of the sleeves 172, 174, 176—thus, while the sleeves 172, 174, 176 are held in their unlocking positions (with the fingers 272, 274, 276 extending into the toothless positions of the sleeves 172, 174, 176 so that the sleeves 172, 174, 176 can not be moved out of their unlocking positions), the dials 202, 204, 206 are reoriented to reflect a combination that will operate the lock when the internal teeth 187 of the dials 202, 204, 206 are brought back into engagement with the external teeth 177 of the sleeves 172, 174, 176.

What renders the quarter-turn shackle position shown in FIG. 17 safer for resetting the combination of the lock 100 than the half-turned position shown in FIG. 17 is that, when the shackle 120 is in the quarter-turned position of FIG. 17, the projections 131 on the longer leg 126 of the shackle 120 underlie the top wall 113 of the padlock's housing 110 to prevent the shackle 120 from accidentally popping up under the influence of the spring 145 which biases the longer leg 126 upwardly relative to the housing 110. If the dials 202, 204, 206 are moved relative to the sleeves 172, 174, 176 while the shackle 120 is being manually depressed as shown in FIG. 16, the person holding the shackle 120 manually depressed in opposition to the action of the spring 145 runs the risk of letting the shackle 120 slip (or of weakening his grip on the depressed shackle 120 enough that the shackle 120 is no longer held in the fully depressed position illustrated in FIG.

16) which may cause some of the teeth 177, 187 to engage, resulting in an unwanted and unknown combination being set.

At the heart of the padlock 100 are pairs of components—relatively movable components—that latchingly engage to "lock" the lock 100, and that disengage to "unlock" the lock 100. The relatively movable components that engage and disengage to lock and unlock the lock 100 are the teeth 177 of the shackle-carried sleeves 172, 174, 176, and the fingers 272, 274, 276 of the slide member 270. If even one of the teeth 177 underlies even one of the fingers 272, 274, 276, the lock 100 is locked; however, if none of the teeth 177 underlie any of the fingers 272, 274, 276, the lock 100 is unlocked because, when this is true, nothing prevents the spring 145 from popping the shackle 120 upwardly to its unlocked position wherein the short leg 124 of the shackle 120 disengages from the housing 110.

When even one of the dials 202, 204, 206 is turned to a position that does not contribute to the setting of a proper combination, the offending dial causes at least one associated tooth 177 of an associated one of the sleeves 172, 174, 176 to underlie at least an associated one of the fingers 272, 274, 276, and, when this is true, the shackle 120 is prevented from popping up to its unlocked position. However, when a proper combination is set, all of the sleeves 172, 174, 176 are turned by the dials 202, 204, 206 to withdraw all of the teeth 177 from beneath all of the fingers 272, 274, 276, which permits the spring 145 to pop the shackle 120 up to its unlocked position.

Likewise, when the key 175 is inserted into the keyhole 350 and turned to turn the key cylinder 280, the slide member 270 moves to retract all of the fingers 272, 274, 276 from positions where the fingers 272, 274, 276 may overlie one or more of the teeth 177 of the sleeves 172, 174, 176, and the spring 145 pops the shackle 120 up to its unlocked position regardless of how the dials 202, 204, 206 are turned (i.e., regardless of the combination that may be set on the dials 202, 204, 206).

Thus, the lock 100 can be unlocked either by setting a proper combination using the dials 202, 204, 206 (which turns of the teeth 177 to positions where none of the teeth 177 underlie and engage any of the fingers 272, 274, 276 of the slide member 270), or by using the key 175 to turn the key cylinder 280 to move the slide member 270 to withdraw the fingers 272, 274, 276 from where they may overlie and engage one or more of the teeth 177. Either the teeth 177 move to disengage the fingers 272, 274, 276, or the fingers 272, 274, 276 move to disengage the teeth 177, to unlock the lock 100.

The indicator 300 responds (to change the visual signal it provides, namely by changing from displaying the color "green" to displaying the color "red" through the indicator window 250) only as the result of movement of the slide member 270 in a particular direction—only as the result of the slide member 270 moving to withdraw the fingers 272, 274, 276 from where they may overlie one or more of the teeth 177. Opposite direction movement of the slide member 270 (which occurs as the result of the key 175 turning the key cylinder 280 back to its normal position so the key 175 can be removed from the keyhole 350 after the key 175 has been inserted into the keyhole 350 and turned to turn the key cylinder 280 to unlock the lock 100 by moving the slide member 270 as just described) does not cause the indicator 300 to reset.

Indeed, movement of the slide member 270 back toward the dials 202, 204, 206 simply causes the depending tab 279 of the slide member 270 to disengage the indicator 300, which leaves the indicator 300 in the position to which it has been moved by the tab 279 when the slide member 270 moved away from the dials 202, 204, 206—a position wherein the indicator 300 displays the color "red" through the indicator window 250.

No movement of any component of the lock 100 that results from manipulation of the dials 202, 204, 206 to set a combination causes the indicator 300 to change the signal provided by the indicator 300. Key usage in the keyhole 350 (which causes the slide member 270 to retract the fingers 272, 274, 276 of the slide member 270 from positions where the fingers 272, 274, 276 may overlie and engage one or more of the teeth 177) is what causes the indicator 300 to change from displaying "green" to displaying "red." What causes the indicator 300 to change from displaying "red" to displaying "green" (i.e., what causes the indicator 300 to reset) is movement of the reset member 310 in response to depression of the shackle 120 in the manner that has been described above—shackle movement that is designed to cause the indicator 300 to reset.

Thus, the indicator 300 moves between its two signalling positions as the result of the movements of two different components of the lock 100—as the result of the slide member 270 being moved when the key 175 is turned to unlock the lock 100, or as the result of the reset member 310 being moved when the shackle 120 is depressed from an unlocked position while being turned to such positions as are depicted in FIGS. 16 and 17 (which can only take place when the key 175 is not being used to unlock the lock 100—hence the indicator 300 is prevented from being reset at times when the key 175 is being used to unlock the lock 100, as has been described above).

II. The Padlock 500 of FIGS. 20-37

Referring to FIGS. 20-24, a second padlock embodiment is indicated generally by the numeral 500. The padlock 500 has a housing 510 and a shackle 520. As can be seen in the front view of FIG. 20, an aperture or window 530 defined by the housing 510 permits an indicator 540 protectively enclosed within the housing 510 to be viewed in the same manner that the padlock 100 provides an aperture or window 250 for viewing of a protectively enclosed indicator 300.

As will be more fully explained, the padlock 500 includes, within the interior of the housing 510, a key mechanism (or a key-operated or key-responsive mechanism) that makes use of a housing-defined keyhole 550 configured to admit the end region 176 of the key 175 such as is depicted in FIG. 1, or a suitably configured governmentowned key-like tool (not shown) having an end region configured like the end region 176 of the key 175 shown in FIG. 1.

As will also be more fully explained, the padlock 500 also includes a combination mechanism (or a combination-operated or combination-responsive mechanism) that includes three dials 602, 604, 604 which project through separate, housing-defined, parallel extending slots 612, 614, 614, respectively. Indicia such as numbers, letters, symbols or the like are normally provided on the dials 602, 604, 606 so that the dials 602, 604, 606 can be turned to set a correct combination sequence that will ready the padlock 500 to have a push button 700 depressed to release the shackle 520 so the shackle will move from the locked position shown in FIG. 20 to an unlocked position such as is shown in FIG. 21.

The padlock embodiment 500 incorporates many of the features and operational characteristics of the padlock embodiment 100. Some of the similarities of the padlocks 100, 500, and a few of the differences that distinguish the padlocks 100, 500, are worthy of mention, before turning to a detailed description of the components and operation of the second padlock embodiment 500.

Features and characteristics that the padlocks 100, 500 have in common include 1) a housing that receives both end regions of a shackle when the shackle is locked, and only one of the shackle's end regions when the shackle is unlocked, 2) a housing that encloses both a key mechanism (or key operated mechanism) and combination mechanism (or combination operated mechanism), each of which can be used independently and alternatively to unlock the shackle of the padlock, 3) three dials that are carried in separate housing-defined slots for setting a combination to unlock the padlock, and 4) a housing that is defined by two mating halves or shells which cooperate to form opposite side portions of a keyhole into which the key 175 (or a somewhat similar key-like tool, not shown) may be inserted and turned to unlock the padlock.

Figure 23:
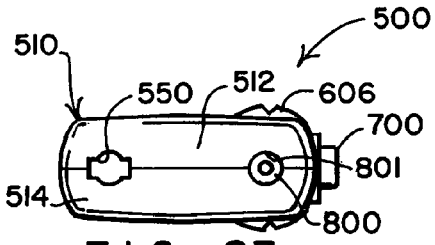
FIG. 23 is a bottom view of the padlock of FIG. 20 showing a housing-defined keyhole of a key mechanism (or key-operated mechanism) of the padlock.

Distinguishing features of the padlocks 100, 500 include the facts that 1) whereas the padlock 100 has a rigid, U-shaped, solid-metal shackle 120, the padlock 500 has a shackle 520 that is defined, at least in part, by a flexible cable 522, 2) whereas the padlock 100 provides a housing-defined keyhole 350 located along a relatively narrow side of the padlock 100 as can be seen in FIG. 1, the padlock 500 provides a housing-defined keyhole 550 located along a relatively narrow bottom of the padlock 500 as can be seen in FIG. 23, and 3) although the padlock 100 includes no push-button to release its shackle 120, the padlock 500 provides a push button 700 that must be depressed to release the shackle 520 regardless of whether the act of inserting and turning the key 175 in the keyhole 550, or the act of setting a correct combination using the dials 602, 604, 606 has been employed to ready the padlock 500 for release of its shackle 520.

The padlocks 200, 500 have many other differences that will become apparent as the description that follows unfolds, including the very different provisions that are made by the padlocks 200, 500 for resetting the combinations used to unlock the padlocks 200, 500. As has been explained, the padlock 200 requires manipulation of the opened shackle 120 to reset the combination used to open the padlock 200, which is quite unlike the use of a depressable, shaft-like element 800 (shown in FIGS. 23 and 24) that is employed during resetting of the combination used to unlock the padlock 500.

Figure 24:
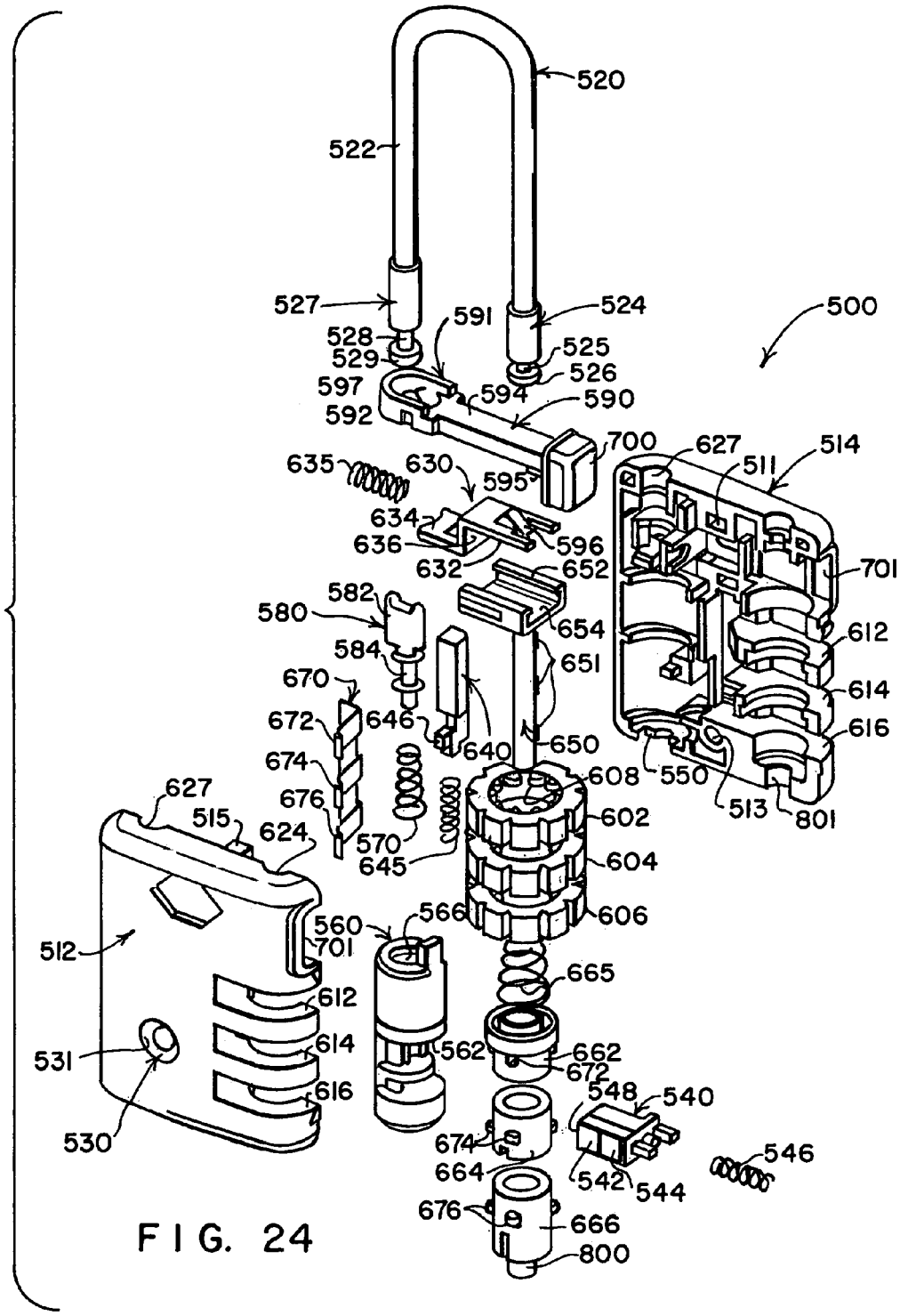
FIG. 24 is an exploded perspective view showing two halves or shells of the housing separated, and showing internal components of the padlock.

Components of the padlock 500 are depicted in the exploded view of FIG. 24. Referring to FIG. 24, the housing 510 of the padlock 500 is defined by a front half or front shell 512, and by a rear half or rear shell 514 which mate to protectively enclose all of the other components depicted in FIG. 24 except for most of the shackle 520. The housing halves or shells 512, 514 are held together by formations 515, 517 (shown in FIGS. 33 and 34) of the front housing half or shell 512 which are crimped or otherwise suitably flattened after extending through holes 511, 513 (shown in FIGS. 24 and 25) that are defined by the rear housing half or shell 514.

Referring to FIG. 24, a central part of the shackle 520 is defined by an elongate, flexible and sever-resistant cable 522. Opposite end regions of the flexible cable extend into and are securely connected to cylindrical metal end formations 524, 527. The metal end formations 524, 527 have reduced diameter necks 525, 528 that connect with larger diameter head formations 526, 529, respectively, which are located at opposite ends of the shackle 520.

Figure 20:
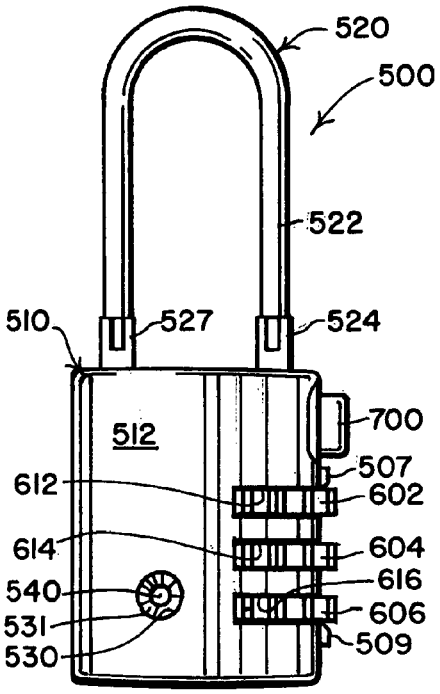
FIG. 20 is a front elevational view of a second embodiment of a combination and key operated padlock having an indicator surface that is visible through an aperture or window formed through a front wall of a housing of the padlock, with a shackle of the padlock being formed, at least in part, by a flexible cable, and shown in its locked position.
Figure 21:
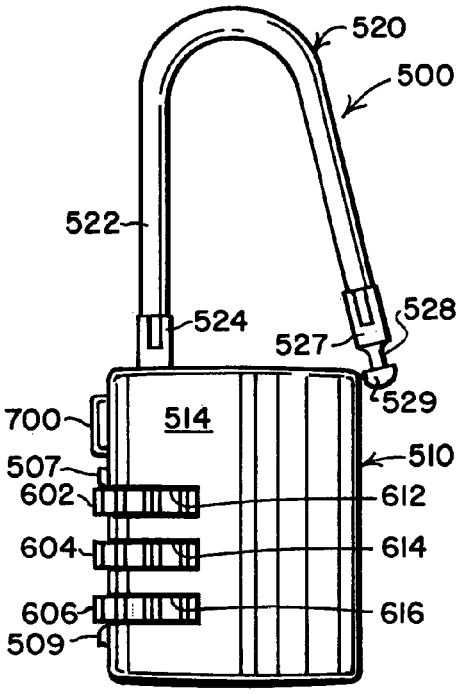
FIG. 21 is a rear elevational view of the padlock of FIG. 20, with the flexible shackle of the padlock shown in an unlocked position.
Figure 22:
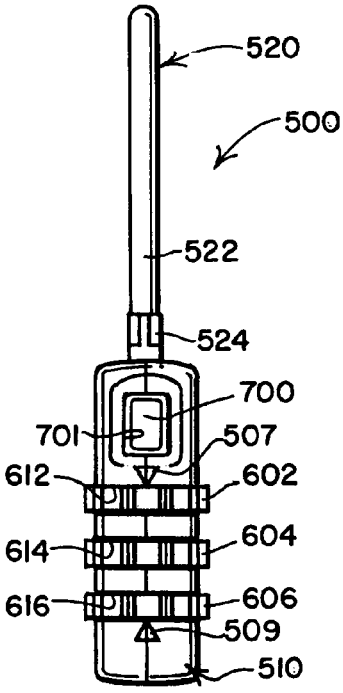
FIG. 22 is a right side elevational view of the padlock of FIG. 20 showing dials of a combination mechanism (or combination-operated mechanism) of the padlock projecting through housing-defined slots, and showing a depressable push for releasing the flexible shackle from its locked position.

As is best seen in FIG. 20, the front half or shell 512 of the housing 510 provides the aperture or window 530 with a beveled outer end region 531 that directs one's focus to the center of the window 530 where a portion of the movable indicator 540 is viewable. The aperture or window 530 normally displays a green surface 544 of the indicator 540 unless the padlock 500 has been unlocked by use of a key 175 such as is shown in FIG. 1. If a key such as the key 175 shown in FIG. 1 has been used to unlock the padlock 500 (and if the indicator 540 has not been reset to display the green surface 544), the aperture or window 530 will display a red surface 542 of the indicator 540.

Figure 25:
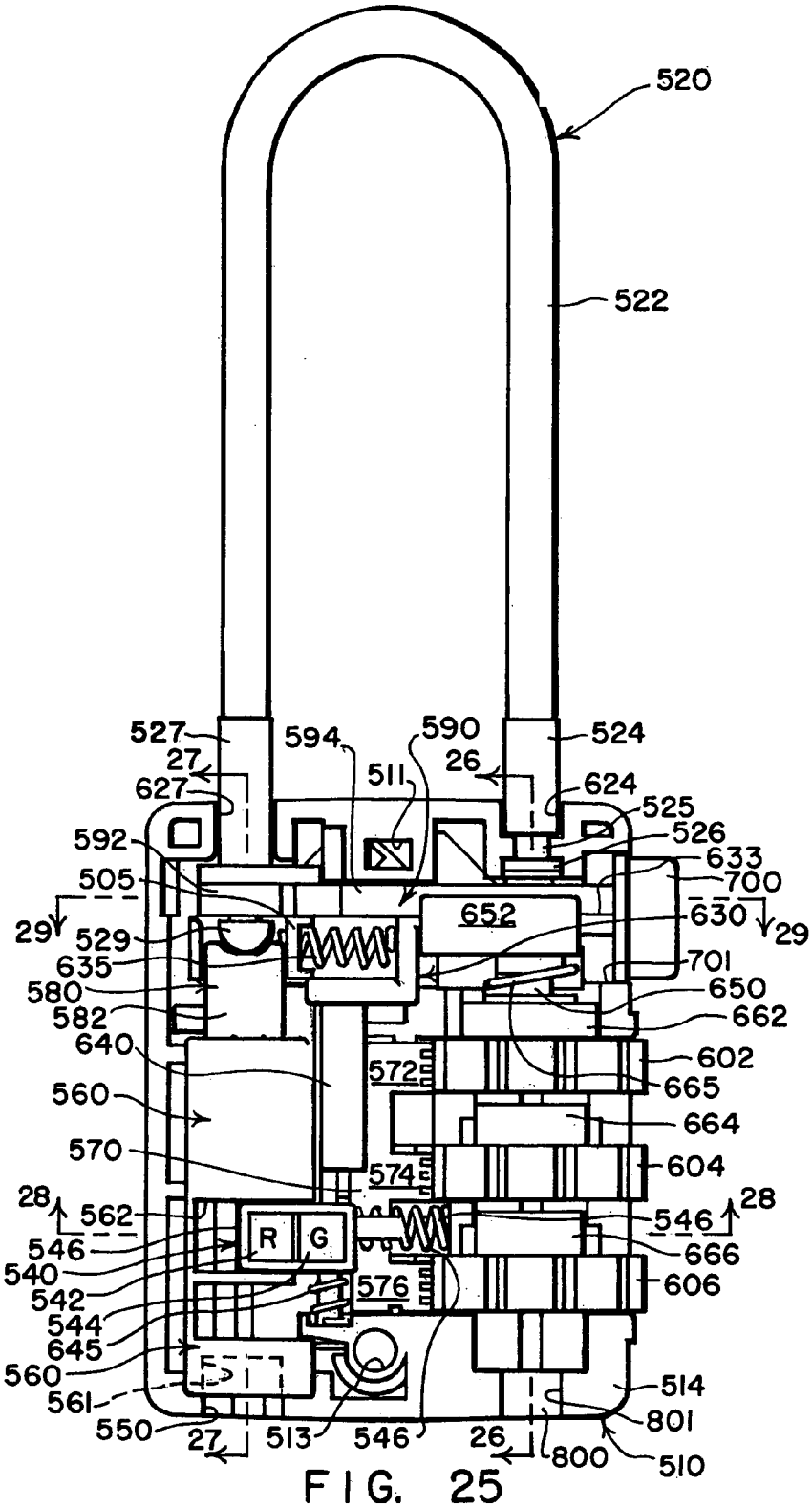
FIG. 25 is an enlarged front elevational view of the padlock with a front half or front shell of the housing removed to permit internal components of the padlock to be seen.
Figure 26:
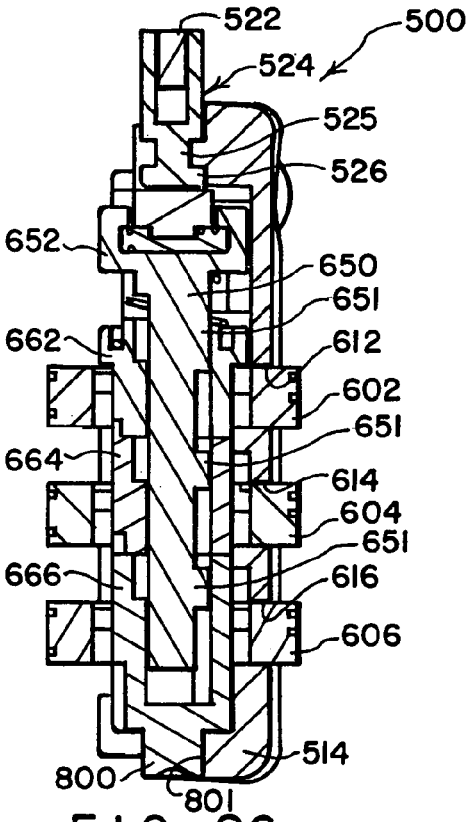
FIG. 26 is a cross-sectional view as seen from a plane indicated by a line 26-26 in FIG. 25.
Figure 27:
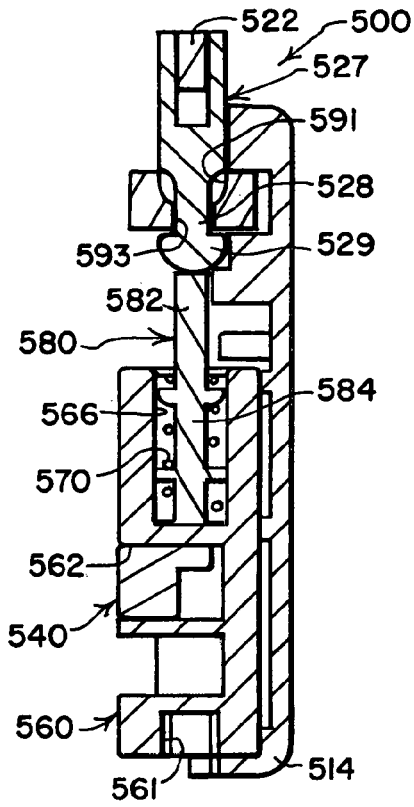
FIG. 27 is a cross-sectional view as seen from a plane indicated by a line 27-27 in FIG. 25.
Figure 28:
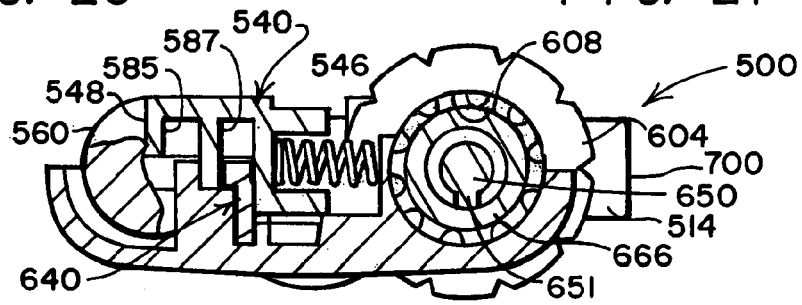
FIG. 28 is a cross-sectional view as seen from a plane indicated by a line 28-28 in FIG. 25.
Figure 29:
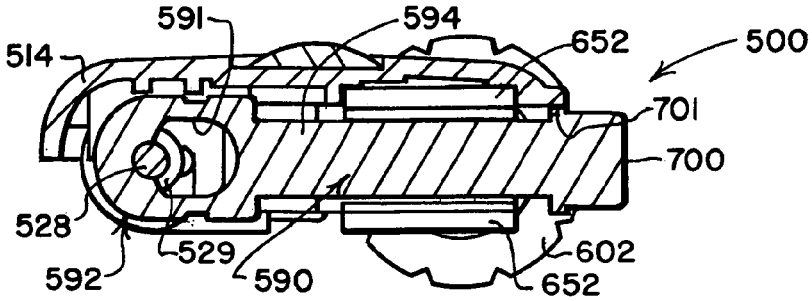
FIG. 29 is a cross-sectional view as seen from a plane indicated by a line 29-29 in FIG. 25.
Figure 33:
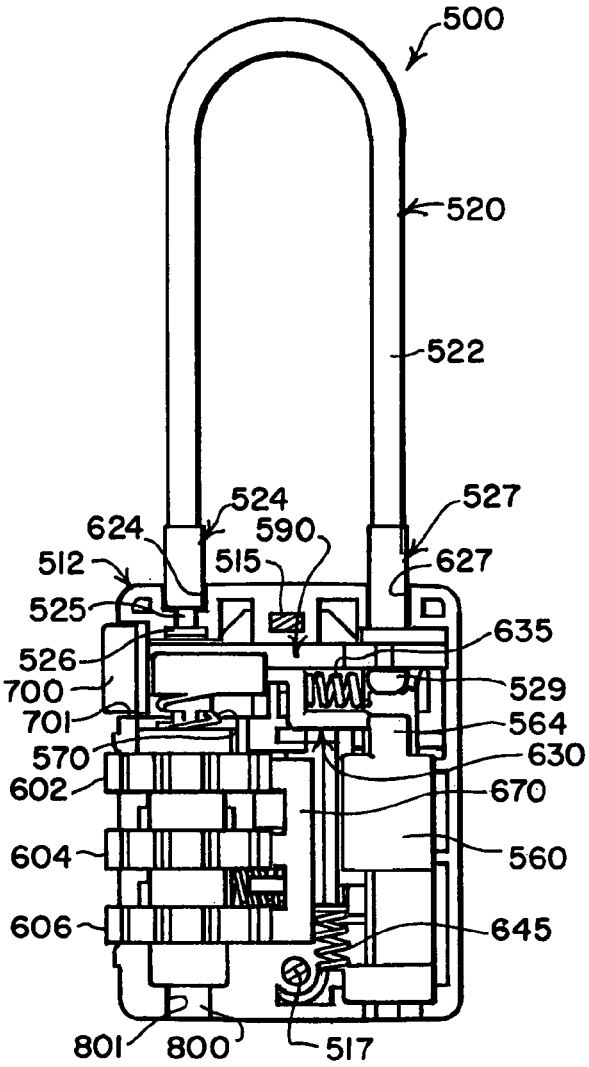
FIG. 33 is a rear view of the selected components of the padlock with a rear housing half or rear housing shell removed, and with the shackle locked.
Figure 34:
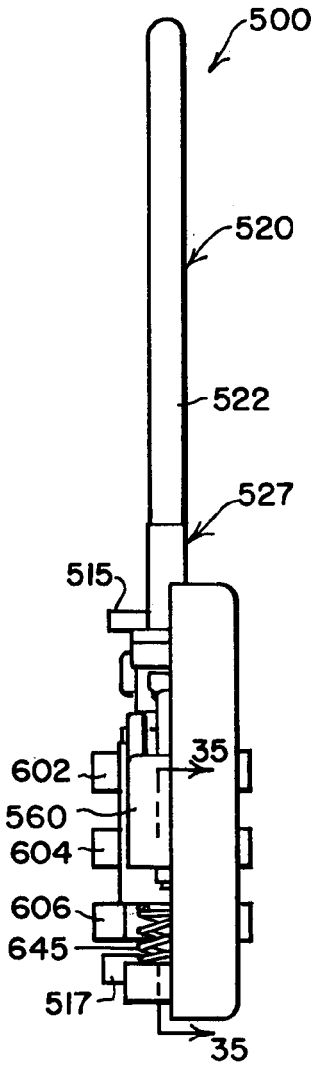
FIG. 34 is a right side view of the lock components that are shown in FIG. 33.
Figure 35:
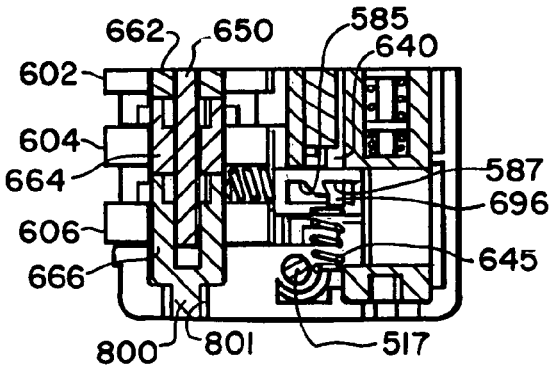
FIG. 35 is a sectional view as seen from a plane indicated by a line 35-35 in FIG. 34.

In the description that follows, the terms left, right, leftward, rightward, leftwardly and rightwardly all refer to the padlock 500 and its component parts as shown in the front views of FIGS. 20 and 25, not as depicted in the rear views of FIGS. 21 and 33.

A compression coil spring 546 carried inside the housing 510 at a location to the right of the indicator 540 biases the indicator 540 leftwardly toward a position that aligns the green surface 544 with the aperture or window 530 (i.e., toward a green-displaying position). However, as will be explained, if the padlock 500 has been opened by the key 175 causing the indicator 540 to move rightwardly to display the red surface 542 in the window 530 (i.e., to a red-displaying position), an indicator reset member 640 carried inside the housing 510 will retain the indicator 540 in its red-displaying position until the indicator reset member 640 releases the indicator 540 thereby permitting the indicator 540 to move leftwardly to its green-displaying position.

Top portions of the front and rear halves or shells 512, 514 of the housing 510 cooperate to define openings 624, 627 through which the shackle's metal end formations 524, 527, respectively, may extend into the housing 510. At a location interiorly of the opening 624, the front and rear halves 512, 514 are configured to receive and grip the reduced diameter neck 525 of the metal end formation 524 of the shackle 520 to permanently retain a portion of the shackle's metal end formation 524 within the housing 510.

As will be explained shortly, when the shackle 520 of the padlock is locked, the reduced diameter neck 528 of the shackle's metal end formation 527 is intended to extend through and to be gripped by a complexly configured opening 591 that is formed through an enlarged left end region 592 of an elongate release lever 590. And, as will be explained shortly, when the push button 700 (which is located at the right end region of the elongate release lever 590) is depressed to move the release lever 590 leftwardly, this leftward movement of the release lever 590 causes the complexly configured opening 591 to move to a position wherein it releases its grip on the neck 528 of the metal end formation 527 of the shackle 520, so the shackle's metal end formation 527 can pop up out of the housing 510 (i.e., can be ejected from the housing 510) to an unlocked position such as is depicted in FIG. 21.

Bottom portions of the front and rear halves or shells 512, 514 cooperate to define opposite sides of the keyhole 550, as can best be seen in FIG. 23. How the interior of the rear half or shell 514 is configured in the vicinity of the keyhole 550 can best be seen in the exploded view of FIG. 24. The interior of the front half or shell 512 is similarly configured in the vicinity of the keyhole 550.

Referring again to FIG. 24, supported within the housing 510 at a location just above the keyhole 550 is an elongate, generally cylindrical key-operated cam member 560. The cam member 560 has a bottom end opening 561 (FIGS. 25 and 27) that is configured to matingly receive the end region 176 of the key 175 that is shown in FIGS. 1 and 2, so the cam member 560 can be turned within the housing 510 when the key's end region 176 is inserted through the keyhole 550 into the end opening 561, and when the inserted key 175 is then turned. The cam member 560 is normally retained in the orientation shown in FIGS. 24 and 25 due to the biasing action of the spring 546 which biases the indicator 540 leftwardly and presses a left end region 548 of the movable indicator member 540 into a carved out cam-carrying region 562 of the cam member 560.

The carved out region 562 of the cam member 560 also interacts in another way with a left end region 548 of the movable indicator member 540. When the key's end region 176 is received in the bottom end opening 561 of the cam member 560 and the inserted key 175 is turned to cause the cam member 560 to turn, a cam defined at the rear of the carved out region 562 engages the left end region 548 of the indicator 540 to cause rightward movement of the indicator member 540 to a position where the red surface 542 of the indicator 540 is viewable through the aperture or window opening 530. When the left end region 548 of the movable indicator member 540 is pressed into the carved out region 562 (as depicted in FIG. 25), the green surface 544 of the indicator 540 is aligned with and is viewable through the aperture or window opening 530.

An upper end region of the cam member 560 is provided with an upwardly extending tab 564 that, as will be explained, normally blocks leftward movement of a doglegged slide member 630 of the padlock 500. The upper end region of the cam member 560 is also provided with a downwardly extending hole 566 into which a compression coil shackle release spring 570 is inserted. A lower portion 584 (FIG. 24) of a shackle release member 580 depends into the hole 566 and is engaged by the release spring 570, which biases the shackle release member 580 upwardly to a position where an upper portion 582 of the release member 580 is positioned to engage the enlarged head 529 of the shackle's metal end formation 527 when the shackle's metal end formation 527 is in its locked position, as is shown in FIG. 25.

Figure 30:
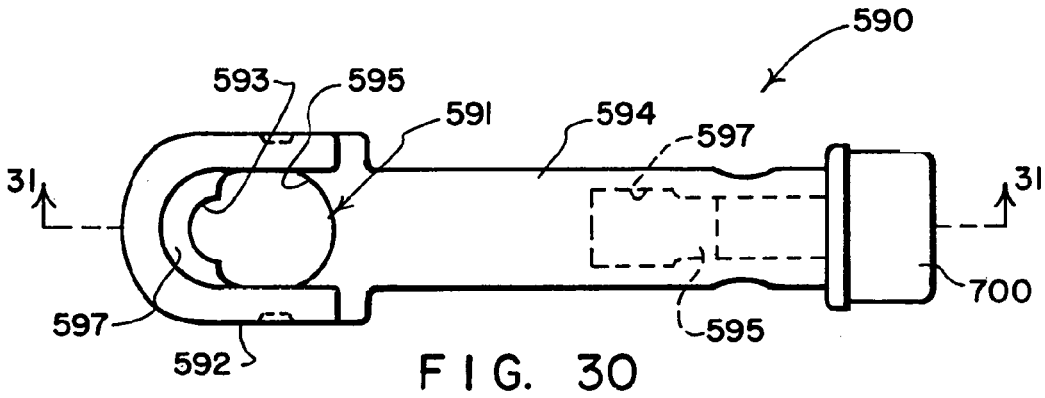
FIG. 30 is a top view, on an enlarged scale, of an elongate release lever component of the padlock.
Figure 31:
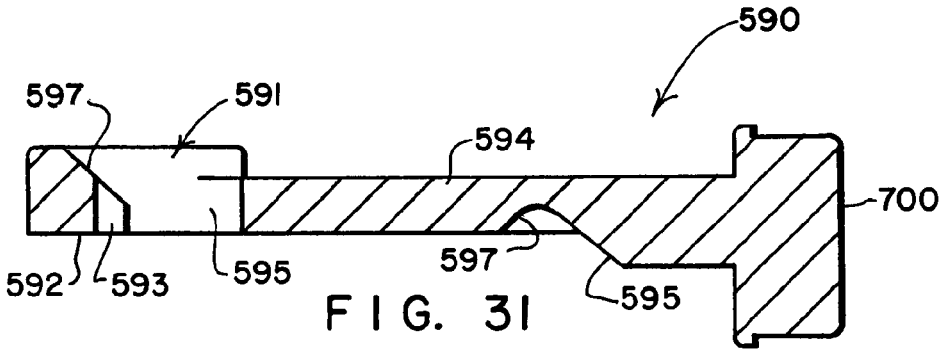
FIG. 31 is a sectional view as seen from a plane indicated by a line 31-31 in FIG. 30.
Figure 32:
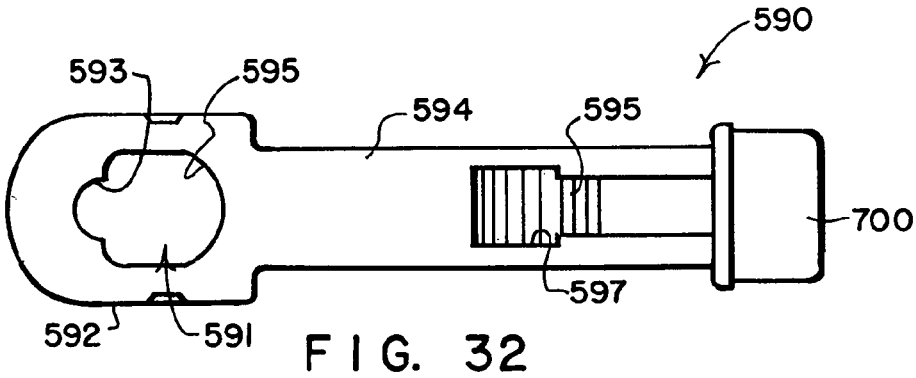
FIG. 32 is a bottom view of the release lever.

An elongate, complexly configured release lever 590 extends horizontally through an upper portion of the interior of the housing 510. FIGS. 30-32 provide an enlarged scale depiction of features of the elongate release lever 590, and FIG. 31 provides a cross-sectional view of the complexly configured opening 591, which is formed through the enlarged formation 592 that forms the left end region of the release lever 590. As is best seen in the bottom view of FIG. 32, the opening 591 has a relatively narrow left end region 593 that is suited to receive and grip the narrow neck 528 of the shackle's metal end formation 527. The opening 591 also has a relatively wide right end region 595 through which the enlarged head 529 of the shackle's metal end formation 527 can pass. How the neck 528 extends into and is gripped by the narrow left end region 593 of the release lever 590 also is shown by the cross-sectional view of FIG. 29.

As is best seen in the sectional view of FIG. 31, an upper portion 597 of a left end region 593 of the complexly configured opening 591 is inclined sufficiently to enable a forceful depression of the enlarged head 529 of the shackle's metal end formation 527 to cause leftward movement of the release lever 590 (if such leftward movement is needed in order to permit insertion of the enlarged head 529 through the opening 591 so the head 529 can reside beneath the release lever 590 in the manner shown in FIG. 25).

The release lever 590 is normally biased rightwardly, causing the push button 700 to project a substantial distance from the housing 510 through a housing opening 701, as depicted in FIGS. 1, 2 and 25. This rightward biasing of the elongate release lever 590 is due to the biasing action of a spring 635 which, as will be explained, acts to rightwardly bias a doglegged slide 630 located below the release lever 590. The slide 630 transfers the biasing action of the spring 635 to the release lever 590.

When the push button 700 is depressed causing leftward movement of the release lever 590, the relatively large diameter right end region 595 of the opening 591 moves leftwardly to surround the metal end formation 527, which permits the enlarged head 529 of the shackle's metal end formation 527 to pass upwardly through the opening 591. As the shackle's metal end formation 527 is pushed upwardly and is ejected from the housing 510 by the upwardly moving release member 580, the upper end region 582 of the release member 580 moves into and through the complexly configured opening 591 of the release lever 590 to a position where the upper end region 582 of the release member 580 is restrained from moving farther upwardly by its engagement with an interior portion of the housing 510 (not shown) located just inside the housing-defined hole 627. The release lever 590 does not move rightwardly (i.e., does not return to its normal position wherein the push button 700 extends substantially from the housing 510 as depicted in FIGS. 1, 2 and 25) until the shackle's metal end formation 527 is reinserted into the housing-defined hole 627, and until the enlarged head 529 of the shackle's metal end formation 527 is inserted through the opening 591 to a position where the enlarged head 529 underlies the enlarged end region 592 of the release lever 590, as is depicted in FIG. 25.

As can be seen in FIGS. 30-32, the elongate, complexly configured release lever 590 has an elongate central region 594 of generally rectangular cross-section that extends between the enlarged left end formation 592 and the push button 700 formed by the right end region of the release lever 590. Provided on the underside of the central region 594 is an inclined surface 595 that is positioned so it can engage and interact with a similarly inclined surface 596 (best seen in FIG. 24) formed on the doglegged unlocking slide 630 that is located just beneath the release lever 590. The release lever 590 also has a depression 597 formed on its underside that can receive and mate with an upwardly projecting portion of the inclined surface 596 of the unlocking slide 630.

The doglegged configuration of the unlocking slide 630 includes a horizontal extending upper portion 632 that defines the inclined surface 596, a horizontal extending lower portion 634 that extends toward the upstanding tab 566 of the generally cylindrical unlocking cam 560, and a vertical portion 636 that extends between and connects the upper and lower horizontally extending portions 632, 634. A compression coil spring 635 has a left end region that engages an internal formation 505 (FIG. 25) of the housing 510, and a right end region that presses against the vertical portion 636 of the unlocking slide 630 to bias the unlocking slide 630 rightwardly within the interior of the housing 510.

When the unlocking cam 560 is turned to its normal position (by the presence of the left end region 548 of the leftwardly biased indicator 540 extending into and engaging the carved-out region 562 of the unlocking cam 540 as shown in FIG. 25), the upwardly extending tab 564 of the unlocking cam 560 blocks leftward movement of the slide 630. When, however, the unlocking cam 560 is turned by the key 175 a half turn to unlock the padlock 500, the upwardly extending tab 564 is also turned a half turn and is therefore moved out of the path of leftward movement of the slide 630, which permits the slide 630 and the release lever 590 to move leftwardly as is needed to release the grip of the complexly configured opening 591 on the neck 528 of the shackle's metal end formation 527, so the shackle's metal end formation 527 can be ejected from the housing 510 due to upwardly biased movement of the release member 580.

Extending vertically within a central part of the interior of the housing 510 is an elongate indicator reset member 640. A compression coil spring 645 is installed just below the reset member 640. The spring 645 engages and upwardly biases the reset member 640. A lower end of the spring 645 engages an internal formation (not shown) of the housing 510.

A forwardly-extending projection 646 is defined on a lower portion of the indicator reset member 640. As can best be seen in FIG. 35, the projection 646 extends forwardly at a location beneath the indicator 540. The spring 645 biases the projection 646 into one of two notches 585, 587 (FIG. 35) that are provided on a bottom rear surface of the movable indicator member 540. If the projection 646 extends into one of the two notches 585, 587 of the indicator 540, the indicator 540 will be held by the reset member 640 in a position that causes the red surface 542 of the indicator 540 to be displayed through the aperture or window 530 of the housing 510. If the projection 646 extends into the other of the two notches 585, 587 of the indicator 540, the reset member 640 will hold the indicator 540 in a position that causes the green surface 544 to be displayed through the aperture or window 530.

If the indicator reset member 640 is depressed while the red surface 542 of the indicator 540 is visible through the aperture or window 530, the forwardly extending projection 646 of the indicator reset member 640 will move downwardly in opposition to the upward biasing action of the spring 645 to disengage the notches 585, 587 of the indicator 540, thereby releasing the indicator 540 to move leftwardly under the influence of the spring 545 to a position where the green surface 544 is visible through the aperture or window 530. Thus, downward movement of the indicator reset member 640 is all that is needed to reset the indicator 540 to display the color green in the window 530. And, as has been previously explained, unlocking the padlock 500 by use of a key 175 or the like is all that is needed to cause the indicator 540 to display the color red in the window 530.

Figure 36:
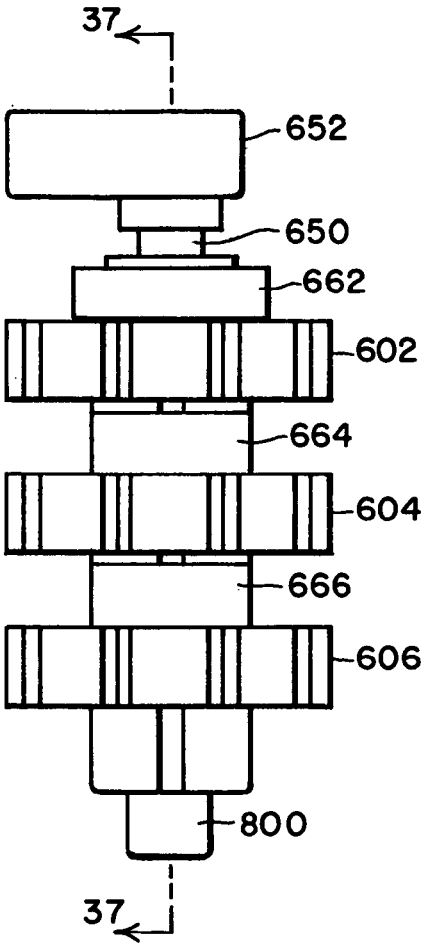
FIG. 36 is a schematic depiction on an enlarged scale of selected components of the combination locking mechanism of the padlock; and, FIG. 37 is a sectional view as seen from a plane indicated by a line 37-37 in FIG. 36.
Figure 37:
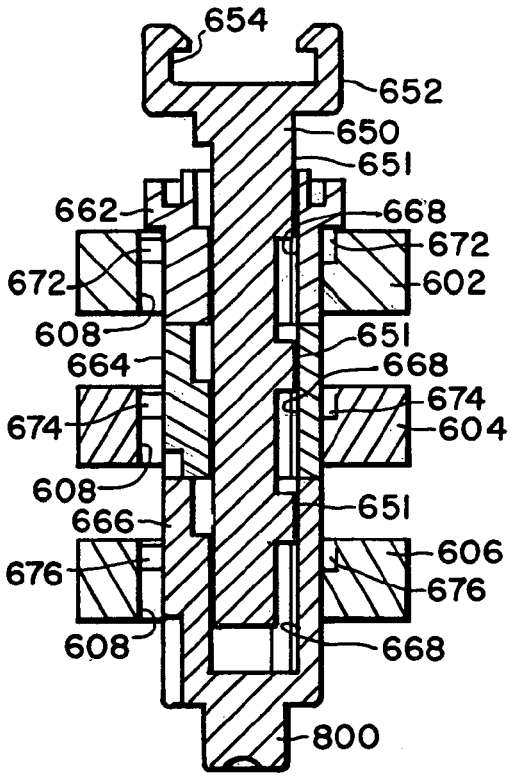

The combination mechanism of the padlock 500 is much like, and functions much like, the combination responsive mechanism or combination operated mechanism of many other padlocks and locks such as are used on briefcases and the like. FIGS. 36 and 37 show selected elements of the combination mechanism of the padlock 500 on an enlarged scale. Referring mainly to FIG. 37, the dials 602, 604, 606 are carried on wheels 662, 664, 666, respectively, that turn on the shaft 650.

When the dials 602, 604, 606 have been turned to set a correct combination for unlocking the padlock 500, this causes slots 668 that are defined by the interiors of the wheels 662, 664, 666 to align with ribs 651 that are formed on the exterior of the shaft 650. As will be explained, the alignment of the ribs 651 with the slots 668 permits axial movement of the shaft 650, which is what is needed in order for the combination mechanism to unlock the padlock 500 by permitting the push button 700 to be depressed to leftwardly move the release lever 590 to release the grip of the release lever's opening 591 on the neck 528 of the shackle's metal end region 527 so the metal end region 527 will be ejected from the housing 510.

The shaft 650 about which the wheels 662, 664, 666 turn has an integrally formed upper end structure 652 that is of generally rectangular shape that defines a horizontally extending slide channel 654. An enlarged depiction of the shaft 650 and its upper end structure 652 is provided in FIGS. 36 and 37. The central region 594 of the release lever 590, and the horizontally extending upper portion 632 of the doglegged unlocking slide 630 are horizontally slidable within the confines of the slide channel 654.

The dials 602, 604, 606 are identical, and have toothed interiors (an example of which is indicated by the numeral 608 in FIG. 24). The toothed interior 608 of the upper dial 602 encircles portions of an upper wheel 662. The toothed interior 608 of the middle dial 604 encircles portions of a middle wheel 664. The toothed interior 608 of the lower dial 606 encircles portions of a lower wheel 666. A compression coil spring 665 (FIG. 24) encircles an upper part of the shaft 650. A bottom end region of the coil spring 665 engages and presses downwardly against the upper wheel 662. An top end region of the coil spring 665 engages an underside of the rectangular formation 652 at the top of the shaft 650.

Referring to FIG. 24, a leaf spring member 670 is carried within the housing 510 and has arms 672, 674, 676 which press against exterior surfaces of the dials 602, 604, 606 to help hold the dials 602, 604, 606 in positions where indicia carried on the circumferences of the dials 602, 604, 606 are properly aligned with one or more arrow formations 507, 509 (FIG. 22) that are provided on the exterior surface of the housing 510 to let the padlock owner know where to align indicia of the dials 602, 604, 606 in setting the combination that will unlock the padlock 500.

The wheels 662, 664, 666 carry small projecting nib formations 672, 674, 676, respectively, on their exterior surfaces that drivingly engage the toothed interior surfaces 608 of the dials 602, 604, 606, respectively. As is well known to those who are skilled in the art of combination lock design, the shaft 650 is provided with ribs 651 (FIGS. 24 and 37) that are drivingly engageable with slots 668 (FIG. 37) in the interiors of the wheels 662, 664, 666. When the wheels 662, 664, 666 have been turned by setting a correct combination using the dials 602, 604, 606, the interior slots 668 of the wheels 662, 664, 666 will align with the ribs 651 of the shaft 650 to permit downward movement of the shaft 650, which permits the push button 700 to be depressed to leftwardly move the release lever 590 to release the grip of the opening 591 on the shackle's neck 528 thereby unlocking the padlock 500.

When the padlock 500 is unlocked by use of a key 175 such as is depicted in FIGS. 1 and 2, the end region 176 of the key 175 is inserted through the keyhole 550 and into the opening 561 (FIG. 25) that is provided in the bottom end region of the cylindrical unlocking cam 560. When the inserted key 175 is turned approximately a half turn, the unlocking cam 560 is caused to turn a corresponding half turn. As the unlocking cam 560 turns, the carved-out, cam-carrying region 562 of the unlocking cam 560 engages and presses against the left end region 548 of the indicator 540, causing the indicator 540 to move rightwardly against the leftward biasing action of the spring 546.

Before the padlock 500 is opened by means of the key 175, the green surface area 544 of the indicator 540 is normally visible through the aperture or window 530. However, the rightward movement of the indicator 540 that results when the padlock 500 is unlocked by the turning of an inserted key 175 (as just explained above) causes the red surface area 542 to be displayed in the aperture or window 530—indicating that the padlock 500 has been unlocked by use of a key 175.

When the generally cylindrical unlocking cam 560 is turned approximately half a turn by the turning of an inserted key 175, the upwardly projecting tab 564 located at the upper end region of the unlocking cam 560 is turned to a position where it no longer blocks leftward movement of the doglegged slide 630. Because the slide 630 can now move leftwardly, the slide 630 no longer serves to block leftward movement of the release lever 590—which means that depression of the push button 700 is possible to release the grip of the release lever's left end region 592 on the neck 528 of the shackle's metal end formation 527. Accordingly, depression of the push button 700 at a time when the unlocking cam 560 has been turned a half turn by an inserted key 175 to unlock the padlock 500 will cause the padlock's shackle 520 to open to an unlocked position such as is depicted in FIG. 21.

When no correct combination is set by using the dials 602, 604, 606, the wheels 662, 664, 666 are turned by the dials to positions that do not align the internal slots 652 of the wheels 662, 664, 666 with the ribs 651 of the shaft 650, thereby obstructing downward movement of the shaft 650. However, when a correct combination for unlocking the padlock 500 is set by turning the dials 602, 604, 606, the wheels 662, 664, 666 are turned by the dials 602, 604, 606 to a position aligning the wheel slots 652 with the shaft ribs 651, the shaft 650 is permitted to move downwardly through the wheels 662, 664, 666. When the shaft 650 can move downwardly, this permits an interaction of the inclined surfaces 595, 596 on the release lever 590 and the slide 630, respectively, to enable the release lever 590 to move leftwardly to release the shackle's metal end formation 527. Accordingly, depression of the push button 700 at a time when a correct combination has been set for unlocking the padlock 500 will cause the padlock's shackle 520 to open to an unlocked position such as is depicted in FIG. 21.

Depression of the push button 700 when a correct combination has been set to unlock the padlock 500 not only causes the release lever 590 to move leftwardly to release the grip of a narrow part of the opening 591 on the neck 528 of the shackle's metal end formation 527, but also causes the inclined surfaces 595, 596 on the release lever 590 and on the doglegged slide 630, respectively, to interact so the slide 630 is caused to move downwardly a short distance. This downward movement of the slide 630 causes the horizontally extending lower portion 632 of the slide 630 to press downwardly against, and to downwardly move, the reset member 640. Downward movement of the reset member 640 disengages the forwardly projecting tab 646 of the reset member 640 from the notches 585, 587 of the indicator 540, thereby permitting the indicator 540 to reset by moving leftwardly under the influence of the spring 545 to display the green surface 544 through the aperture or window opening 530.

Changing the combination that must be set in order to unlock the padlock 500 through use of the dials 602, 604, 606 is a simple undertaking that will be quite familiar to those who are skilled in the art of combination lock design. At a time when a correct combination for unlocking the padlock 500 has been set using the dials 602, 604, 606, the ribs on the shaft 650 are aligned with slots defined internally by the wheels 662, 664, 666. With the lock 500 in this condition, a small depressable shaft-like formation 800 that depends from the lower wheel 666 and that extends into a hole 801 (FIGS. 24, 25, 33 and 35) formed through the bottom wall of housing 510 can be depressed and held in an upward direction to move the wheels 666, 664, 662 upwardly to disengage the nib formations 672, 674, 674 on external surfaces of the wheels 662, 664, 666 from drivingly engaging the toothed interiors 608 of the dials 602, 604, 606. With the driving connection between the dials 602, 604, 606 and the wheels 662, 664, 666 disengaged, the dials 602, 604, 606 can then be turned to set a new combination that will unlock the padlock 500. Finally, the small shaft-like formation 800 that was depressed to move the wheels 662, 664, 666 upwardly is then released to lower the wheels 662, 664, 666 and thereby reestablish driving connections between the dials 602, 604, 606 and the wheels 662, 664, 666, respectively.

Although the internal components of the padlock 500 are depicted in the accompanying drawings as having particular configurations, shapes and appearances, those who are skilled in the art of lock design will readily appreciate that such components as populate the housings of padlocks that also function much like is described herein may differ in their configuration, shape and appearance while still embodying many of the features of the key/combo/indicator types of padlocks that are disclosed herein.

As will be apparent from the foregoing, features that are described herein can bring to combination and key operated locks of many types a resettable, key usage responsive indicator that is well suited to warn lock owners that associated travel bags may have been key opened, perhaps for inspection of their contents.

Although the invention has been described in its preferred form with a certain degree of particularity, it is understood that the present disclosure of the preferred form has been made only by way of example, and that numerous changes in the details of construction and the combination and arrangement of parts may be resorted to without departing from the spirit and scope of the invention as hereinafter claimed. It is intended to protect whatever features of patentable novelty that exist in the invention disclosed.

What is claimed is:

1. A lock having both a combination mechanism and a key mechanism with each being usable independently to unlock the lock, with the lock having an indicator that alters an initial appearance of the lock when the lock is unlocked using the key mechanism, with the indicator being resettable to reestablish the initial appearance of the lock only after a procedure has been followed that includes setting a correct combination for unlocking the lock by use of the combination mechanism.

2. The lock of claim 1 wherein the combination mechanism includes a plurality of dials that can be turned to display sequences of indicia, and the correct combination is set by turning the dials to display a particular sequence of indicia.

3. The lock of claim 1 wherein the indicator displays one color when the lock is unlocked by use of the key mechanism, and a different color when the lock is unlocked by use of the combination mechanism.

4. The lock of claim 1 wherein the lock has a housing and a movable component movably connected to the housing, and said procedure includes the steps of setting the correct combination followed by manually moving the movable component in a particular way.

5. The lock of claim 4 wherein the movable component is a shackle that is opened when the lock is unlocked.

6. The lock of claim 1 wherein the lock is a padlock having a shackle defined, at least in part, by a flexible cable.

7. A lock having both a combination mechanism and a key mechanism that are usable alternatively and independently to unlock the lock, wherein the lock has an indicator that moves from a first position to a second position to alter the appearance of the lock when the lock is opened by use of the key mechanism, with the indicator being returnable to the first position only after a correct combination has been set using the combination mechanism, with the lock additionally including a housing and a movable component movably carried by the housing that must be moved manually at a time after a correct combination has been set in order for the indicator to be returnable to the first position.

8. The lock of claim 7 wherein the lock is a padlock, and the movable component is a shackle of the padlock that is opened when the padlock is unlocked.

9. The lock of claim 7 additionally including a housing and a movable component movably carried by the housing that must be moved manually at a time after a correct combination has been set in order to change the correct combination that must be set to unlock the lock.

10. The lock of claim 9 wherein the movable component is a shaft-like formation that must be depressed into the housing to effect said manual movement.

11. The lock of claim 7 wherein the combination mechanism includes a plurality of dials that can be turned to display a sequence of indicia, and the correct combination is defined by a particular sequence of indicia displayed by turning the dials.

12. The lock of claim 7 wherein the indicator is operable to display one color when the lock is opened by use of the key mechanism, and a different color when the lock is opened by use of the combination mechanism.

13. The lock of claim 12 wherein the indicator is visible through an aperture defined by the housing.

14. The lock of claim 7 wherein the housing is mainly defined by two housing halves that cooperate to define a keyhole through which a key is insertable to operate the key mechanism of the lock.

15. The lock of claim 14 wherein the key mechanism is operated by inserting a key through the keyhole and turning the inserted key.

16. The lock of claim 14 wherein the combination mechanism includes a plurality of dials that can be rotated to display a sequence of indicia, wherein the housing halves cooperate to define a plurality of spaced parallel-extending slots, and wherein the dials extend through different ones of the spaced slots.

17. The lock of claim 7 wherein the housing is mainly defined by two housing halves that cooperate to define two spaced openings that receive opposite end regions of a shackle when the lock is locked, with only one of the two openings being operative to receive an end region of the shackle when the lock is unlocked.

18. The padlock of claim 8 wherein the housing has first and second relatively wide, generally rectangular overlying, spaced apart side surfaces, with overlying edge regions of the side surfaces being joined by four relatively narrow surfaces of the housing, with the indicator being protectively enclosed by the housing and being visible only through a small aperture formed through one of the relatively wide, generally rectangular side surfaces of the housing.

19. The padlock of claim 18 wherein the key mechanism includes a keyhole that opens through one of the four relatively narrow surfaces.

20. A padlock having both a combination mechanism and a key mechanism that each is usable independently of the other to unlock the padlock, with the padlock including an indicator 1) that displays a first appearance as soon as the padlock is unlocked by use of the key mechanism, 2) that displays a second appearance different from the first appearance as soon as the padlock is unlocked by use of the combination mechanism, and 3) that is resettable from displaying the second appearance to displaying the first appearance only after a correct combination for unlocking the padlock is set by use of the combination mechanism.

21. The padlock of claim 20 wherein the padlock has a housing and a movable component that is translatable relative to the housing, wherein the combination mechanism includes a plurality of dials that can be turned relative to the housing to display a combination, and wherein a selected one of the indicator and the combination that must be set to unlock the padlock can only be reset by translating the movable component relative to the housing at a time after the dials have been turned to display a correct combination for unlocking the padlock.

22. The padlock of claim 21 having a shackle with two end regions that are received by the housing when the padlock is locked, with one of the two end regions being released from being received by the housing when the padlock is unlocked.

23. The padlock of claim 22 wherein the shackle is defined, at least in part, by a flexible cable.

24. A lock for luggage that can be unlocked by use of a combination mechanism of the lock, and that alternatively can be unlocked by use of a key mechanism of the lock, with the lock also having a movable indicator that signals when the lock is unlocked by use of the key mechanism, with the indicator being resettable only after the lock has been unlocked by use of the combination mechanism.

25. The lock of claim 24 including a housing and a component movably carried by the housing that must be moved relative to the housing a time after a correct combination has been set in order for the indicator to be reset.

26. The lock of claim 25 wherein the lock is a padlock, and the movable component is a shackle of the padlock that must be moved in a particular way relative to the housing in order for the indicator to be reset.

27. A padlock for luggage that can be unlocked by use of a combination operated mechanism of the padlock, and, alternatively, by use of a key operated mechanism of the padlock, with the padlock including an indicator that provides a signal promptly as the result of the padlock being unlocked by use of the key mechanism, with the padlock having a shackle movable to an open position after a correctly configured key is inserted into and turned in a first direction in the key operated mechanism, and, alternatively, after a correct combination is set by turning dials of the combination operated mechanism.

28. The padlock of claim 27 wherein the indicator ceases providing the signal as a result of the padlock being unlocked using the combination operated mechanism.

29. The padlock of claim 27 wherein an inserted key can only be turned back in a direction opposite the first direction and then removed from the padlock only after the shackle of the padlock has been moved to a locked position, whereby a padlock that has had its shackle unlocked by use of a key permits key removal only after the padlock has been relocked.

* * * * *